US009761244B2

(12) United States Patent
Matsumoto

(10) Patent No.: US 9,761,244 B2
(45) Date of Patent: Sep. 12, 2017

(54) VOICE PROCESSING DEVICE, NOISE SUPPRESSION METHOD, AND COMPUTER-READABLE RECORDING MEDIUM STORING VOICE PROCESSING PROGRAM

(71) Applicant: FUJITSU LIMITED, Kawasaki-shi, Kanagawa (JP)

(72) Inventor: Chikako Matsumoto, Yokohama (JP)

(73) Assignee: FUJITSU LIMITED, Kawasaki (JP)

( * ) Notice: Subject to any disclaimer, the term of this patent is extended or adjusted under 35 U.S.C. 154(b) by 2 days.

(21) Appl. No.: 14/628,416

(22) Filed: Feb. 23, 2015

(65) Prior Publication Data

US 2015/0248895 A1 Sep. 3, 2015

(30) Foreign Application Priority Data

Mar. 3, 2014 (JP) ..... 2014-040649

(51) Int. Cl.
*G10L 21/00* (2013.01)
*G10L 21/0232* (2013.01)
(Continued)

(52) U.S. Cl.
CPC ..... *G10L 21/0232* (2013.01); *G10L 21/0264* (2013.01); *G10L 21/0364* (2013.01);
(Continued)

(58) Field of Classification Search
USPC ..... 704/205–208, 226–228
See application file for complete search history.

(56) References Cited

U.S. PATENT DOCUMENTS

2007/0156399 A1 7/2007 Matsuo
2008/0192956 A1* 8/2008 Kazama ..... G10L 21/0208 381/94.3
(Continued)

FOREIGN PATENT DOCUMENTS

JP 2001-267973 9/2001
JP 2007-183306 7/2007
(Continued)

OTHER PUBLICATIONS

Extended European Search Report issued Jul. 16, 2015 in corresponding European Patent Application No. 15156291.5.
(Continued)

*Primary Examiner* — Leonard Saint Cyr
(74) *Attorney, Agent, or Firm* — Staas & Halsey LLP

(57) ABSTRACT

A voice processing device includes a noise-originating coefficient calculation section that calculates a noise-originating coefficient that gradually decreases as a target value of stationary noise for each frequency increases, the target value being calculated based on an amplitude value of a frequency spectrum obtained by time-frequency transforming a voice signal for a predetermined period of time, and a suppression signal generation section that generates, when the frequency spectrum is determined as being stationary on the basis of the amplitude value, a suppression signal by multiplying a suppression coefficient based on the noise-originating coefficient by the amplitude value, the suppression signal being frequency-time transformed to be output.

15 Claims, 22 Drawing Sheets

(51) Int. Cl.

| | |
|---|---|
| ***G10L 25/84*** | (2013.01) |
| ***G10L 21/0264*** | (2013.01) |
| ***G10L 21/0364*** | (2013.01) |
| *G10L 21/0208* | (2013.01) |
| *G10L 21/0324* | (2013.01) |

(52) U.S. Cl.
CPC ..... *G10L 25/84* (2013.01); *G10L 21/0324* (2013.01); *G10L 2021/02087* (2013.01)

(56) References Cited

U.S. PATENT DOCUMENTS

| | | | | |
|---|---|---|---|---|
| 2010/0092000 | A1* | 4/2010 | Kim | G10L 21/0208 381/58 |
| 2010/0250246 | A1 | 9/2010 | Matsumoto | |
| 2010/0296665 | A1* | 11/2010 | Ishikawa | G10L 21/0208 381/71.1 |
| 2011/0081026 | A1* | 4/2011 | Ramakrishnan | G10L 21/0208 381/94.3 |
| 2013/0191118 | A1 | 7/2013 | Makino | |
| 2013/0216058 | A1 | 8/2013 | Furuta et al. | |
| 2013/0251170 | A1* | 9/2013 | Every | G10L 21/0208 381/71.1 |
| 2014/0200887 | A1* | 7/2014 | Nakadai | G10L 15/20 704/233 |
| 2014/0241546 | A1* | 8/2014 | Matsumoto | H04R 3/04 381/86 |

FOREIGN PATENT DOCUMENTS

| | | |
|---|---|---|
| JP | 2010-204392 | 9/2010 |
| JP | 2010-230814 | 10/2010 |
| WO | WO 2012/098579 | 7/2012 |

OTHER PUBLICATIONS

Masanori Kato et al., "Noise Suppression with High Speech Quality Based on Weighted Noise Estimation and MMSE STSA", Electronics and Communications in Japan, Part 3, Vol, 89, No. 2, 2006, pp. 43-53.

Nils Westerlund et al., "Speech enhancement for personal communication using an adaptive gain equalizer", Signal Processing 85 (2005), pp. 1089-1101.

* cited by examiner

FIG. 4

32

| | |
|---|---|
| NOISE-ORIGINATING COEFFICIENT CALCULATION FORMULA | y=○○○○ |
| CONSTANT | C |

FIG. 11

180

| NOISE LARGE | NOISE SUPPRESSION AMOUNT | | VOICE SUPPRESSION AMOUNT |
|---|---|---|---|
| | STATIONARY | NON-STATIONARY | |
| RELATED ART | 18.2 | 6.1 | 1.8 |
| PRESENT DISCLOSURE | 21.6 | 7.8 | 1.8 |
| COMBINATION OF RELATED ART AND PRESENT DISCLOSURE | 3.4 | 1.7 | 0.0 |

182

| NOISE SMALL | NOISE SUPPRESSION AMOUNT | | VOICE SUPPRESSION AMOUNT |
|---|---|---|---|
| | STATIONARY | NON-STATIONARY | |
| RELATED ART | 18.1 | 10.2 | 1.3 |
| PRESENT DISCLOSURE | 18.5 | 10.8 | 1.3 |
| COMBINATION OF RELATED ART AND PRESENT DISCLOSURE | 0.4 | 0.6 | 0.0 |

FIG. 13

210

| | |
|---|---|
| SUPPRESSION COEFFICIENT (TARGET SOUND RATIO HIGH) | K(f)×C×y |
| SUPPRESSION COEFFICIENT (TARGET SOUND RATIO INTERMEDIATE) | K(f)×C |
| SUPPRESSION COEFFICIENT (TARGET SOUND RATIO LOW) | K(f) |
| FIRST PREDETERMINED VALUE | Th1 |
| SECOND PREDETERMINED VALUE | Th2 |

VOICE PROCESSING DEVICE, NOISE SUPPRESSION METHOD, AND COMPUTER-READABLE RECORDING MEDIUM STORING VOICE PROCESSING PROGRAM

CROSS-REFERENCE TO RELATED APPLICATION

This application is based upon and claims the benefit of priority of the prior Japanese Patent Application No. 2014-040649, filed on Mar. 3, 2014, the entire contents of which are incorporated herein by reference.

FIELD

The embodiments discussed herein are related to a voice processing device, a noise suppression method, and a computer-readable recording medium storing voice processing program.

BACKGROUND

As mobile phones and hands-free telephone calls in an automobile have been widely used, there has been a demand for noise suppression performed at the time of calling under a noise environment. For example, under a noise environment in which stationary noise, such as road noise, and the like, is large, there is a desire for a technique for increasing a noise suppression amount and thus making voice be easily heard. Therefore, there have been attempts to perform noise suppression with less voice distortion on voice data under a noise environment.

For example, there is known a technique for estimating a target value that indicates a level to which the noise is suppressed, based on a representative value of signals obtained by transforming a signal of voice including noise for a predetermined period of time from a time area to a frequency area. There is also another known technique in which a coefficient used for noise suppression is calculated based on an amplitude component of voice for each predetermined frequency band, and the calculated coefficient is multiplied on a signal on the frequency axis of the original signal, thereby suppressing noise. For noise suppression, a technique for controlling upper and lower limits of noise suppression and a technique for correcting a coefficient depending on whether a signal seems to be voice or non-voice are also known (see, for example, International Publication Pamphlet No. WO2012/098579, Japanese Laid-open Patent Publication No. 2001-267973, Japanese Laid-open Patent Publication No. 2010-204392, and Japanese Laid-open Patent Publication No. 2007-183306).

As a related technique, a technique in which whether a plurality of frames having a predetermined length, which are obtained from a voice signal, are voice frames or non-voice frames is determined and a non-stationary frame is detected based on a non-stationary condition that indicates a non-voice frame is non-stationary is known (see, for example, Japanese Laid-open Patent Publication No. 2010-230814).

SUMMARY

According to an aspect of the invention, a voice processing device includes a noise-originating coefficient calculation section that calculates a noise-originating coefficient that gradually decreases as a target value of stationary noise for each frequency increases, the target value being calculated based on an amplitude value of a frequency spectrum obtained by time-frequency transforming a voice signal for a predetermined period of time; and a suppression signal generation section that generates, when the frequency spectrum is determined as being stationary on the basis of the amplitude value, a suppression signal by multiplying a suppression coefficient based on the noise-originating coefficient by the amplitude value, the suppression signal being frequency-time transformed to be output.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

BRIEF DESCRIPTION OF DRAWINGS

FIG. 4 is an example of a coefficient calculation table according to the first embodiment;

FIG. 11 is a table illustrating an example of noise suppression effect of the voice processing device according to the second embodiment;

FIG. 13 is a table illustrating an example of a sound ratio-based coefficient data table according to a third embodiment;

DESCRIPTION OF EMBODIMENTS

In suppressing noise, noise is suppressed at a fixed ratio so as not to cause distortion of voice by suppressing noise. When such noise suppression is performed, noise is expected to be made natural noise that is to be heard when the volume is turned down. However, when noise itself is large, both of residual noise of stationary noise and residual noise of non-stationary noise are increased. On the other hand, when the suppression ratio is simply lowered to increase the noise suppression amount, target voice is mistakenly recognized as noise and the voice is excessively suppressed, so that voice distortion might occur. When, for example, noise is mistakenly recognized as target voice on the other way around, the suppression amount might drastically change in the time direction. The change might cause a drastic change in amplitude, and thus, turns to noise distortion.

According, it is desired to allow noise suppression with less voice distortion.

First Embodiment

A voice processing device 1 according to a first embodiment will be described with reference to the accompanying drawings. The voice processing device 1 is a device that outputs voice, of which a voice signal that has been input thereto has been subjected to noise suppression processing. The voice processing device 1 may be used for preprocessing of a reception sound or a transmission sound of a multifunctional mobile phone, an output sound of a voice output device, such as a speaker, an earphone, and the like, and an input sound for voice recognition, and the like. The voice processing device 1 is provided, for example, in a multifunctional mobile phone, a car-mounted communication device, a voice output device, a voice recognition device, and the like.

Figure 1:
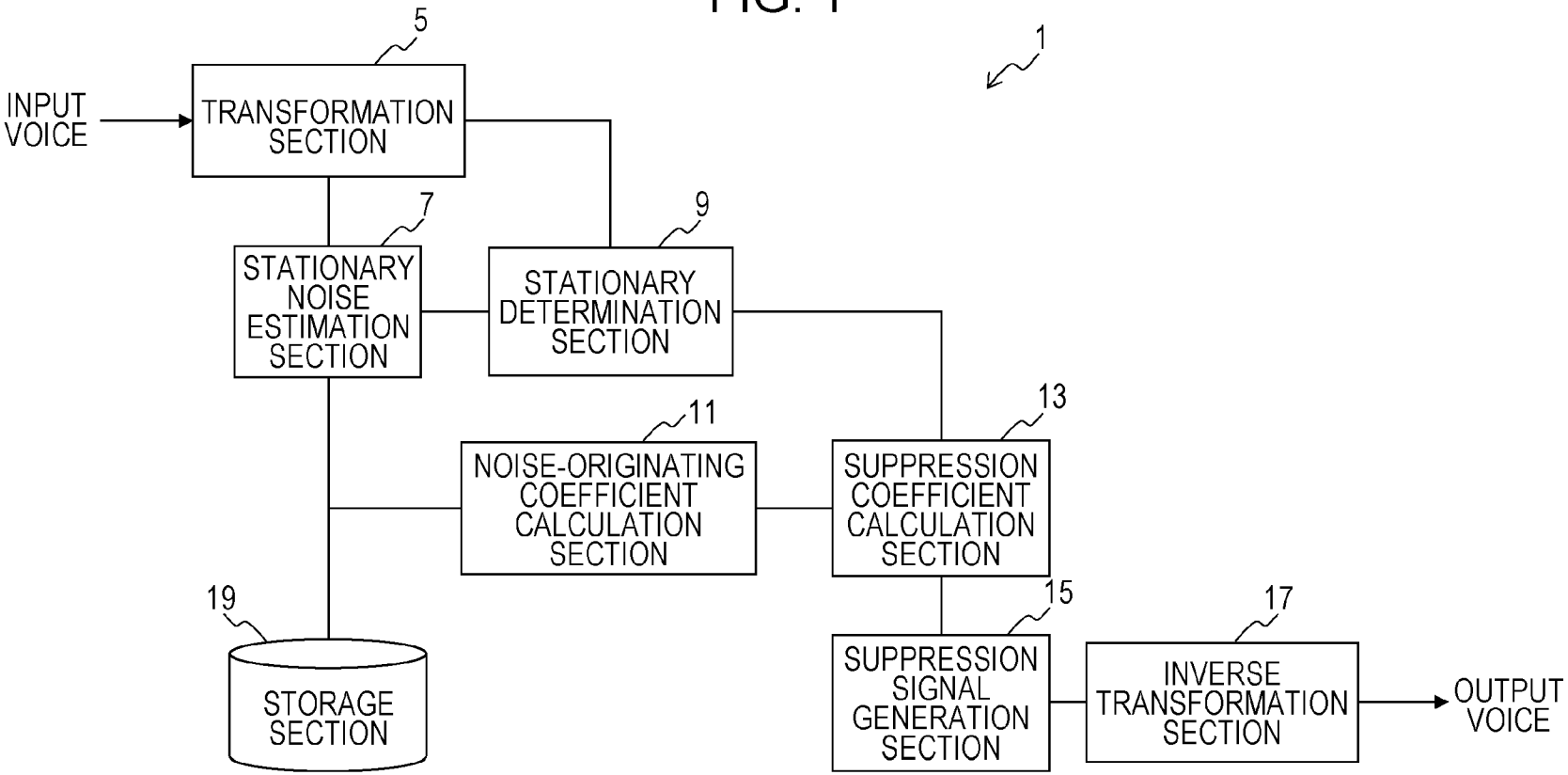
FIG. 1 is a block diagram illustrating an example of a functional configuration of a voice processing device according to a first embodiment.

FIG. 1 is a block diagram illustrating an example of a functional configuration of the voice processing device 1 according to the first embodiment. As illustrated in FIG. 1, the voice processing device 1 includes a transformation section 5, a stationary noise estimation section 7, a stationary determination section 9, a noise-originating coefficient calculation section 11, a suppression coefficient calculation section 13, a suppression signal generation section 15, and an inverse transformation section 17. For example, the voice processing device 1 reads a control program in advance to execute the control program, thereby realizing each of functions performed by the above-described sections. Also, the voice processing device 1 includes a storage section 19.

The transformation section 5 transforms a voice signal on a time axis for a predetermined period of time to a frequency spectrum. In this case, the voice signal includes a mix of target voice, stationary noise, and non-stationary noise. The transformation section 5 cuts out and transforms a signal of a predetermined period of time as a frame in chronological order. The processing, for example, may be performed using a window function such that predetermined periods of time before and behind in chronological order at least partially overlap each other. For example, the transformation section 5 performs Fast Fourier Transform (FFT) on the voice signal. A frame herein is a signal corresponding to a signal in a predetermined period of time cut out when transformation to a signal on a frequency axis is performed, that is, a voice signal in a predetermined period of time, or a frequency spectrum obtained by transforming a voice signal in a predetermined period of time.

The stationary noise estimation section 7 estimates a target value of stationary noise for each frequency, based on an amplitude value for each frequency of a frequency spectrum. The stationary noise estimation section 7 smoothes, for example, the amplitude spectrum of a frequency spectrum in the time axis direction and estimates a target value of residual noise for each frequency. The target value of the estimated noise will be hereinafter also referred to as a value of a stationary noise model. Also, the targets value estimated for each frequency will be collectively referred to as a stationary noise model.

The stationary determination section 9 determines, based on the amplitude value for each frequency of the frequency spectrum, whether a component of each frequency is stationary or non-stationary. Specifically, the stationary determination section 9 may be configured to use, for example, stationary/non-stationary determination described in Japanese Laid-open Patent Publication No. 2010-230814 to calculate the rate of change with time for each amplitude spectrum and determine that a frequency component is non-stationary, when the rate of change with time is higher than a threshold, and that a frequency component is stationary, when the rate of change with time is lower than the threshold.

The noise-originating coefficient calculation section 11 calculates a noise-originating coefficient of "1" or less, which gradually decreases as the target value increases. A calculation formula may be stored, for example, in the storage section 19, and be read out. What is meant by calculating a noise-originating coefficient of "1" or less is that, when a suppression coefficient is "1", suppression is not performed and, as the suppression coefficient decreases from "1", the suppression amount increases, not that the noise-originating coefficient is strictly "1" or less.

When it is determined by the stationary determination section 9 that a frequency component is stationary, the suppression coefficient calculation section 13 obtain a suppression coefficient based on a noise-originating coefficient y, for example, by multiplying a constant C ($0<C\leq1$) and the noise-originating coefficient y together. When it is determined that a frequency component is non-stationary, the suppression coefficient calculation section 13 obtains "1" as a suppression coefficient. The constant C is a value that indicates to what degree stationary noise is suppressed from a target value and, for example, may be stored in the storage section 19 in advance. What is meant by using the constant C of "1" or less is that, when the constant C is "1", suppression is not performed and, as the constant C decreases from "1", the suppression amount increases, not that the noise-originating coefficient is strictly "1" or less.

The suppression signal generation section 15 generates a suppression signal obtained by multiplying an amplitude value for each frequency of the frequency spectrum and a corresponding suppression coefficient. The inverse transformation section 17 frequency-time transforms the suppression signal and outputs the frequency-time transformed suppression signal. To collectively describe these, Expression 1 and Expression 2 below are obtained.

$$\text{Suppression coefficient} = \text{Constant } C \times \text{Noise-originating coefficient } y \text{ (stationary)}. \quad \text{Expression 1}$$

$$\text{Suppression coefficient} = 1 \text{ (non-stationary)}. \quad \text{Expression 2}$$

What is meant by making the suppression coefficient be "1" is that suppression is not positively performed, not that the suppression coefficient is strictly "1".

Figure 2:
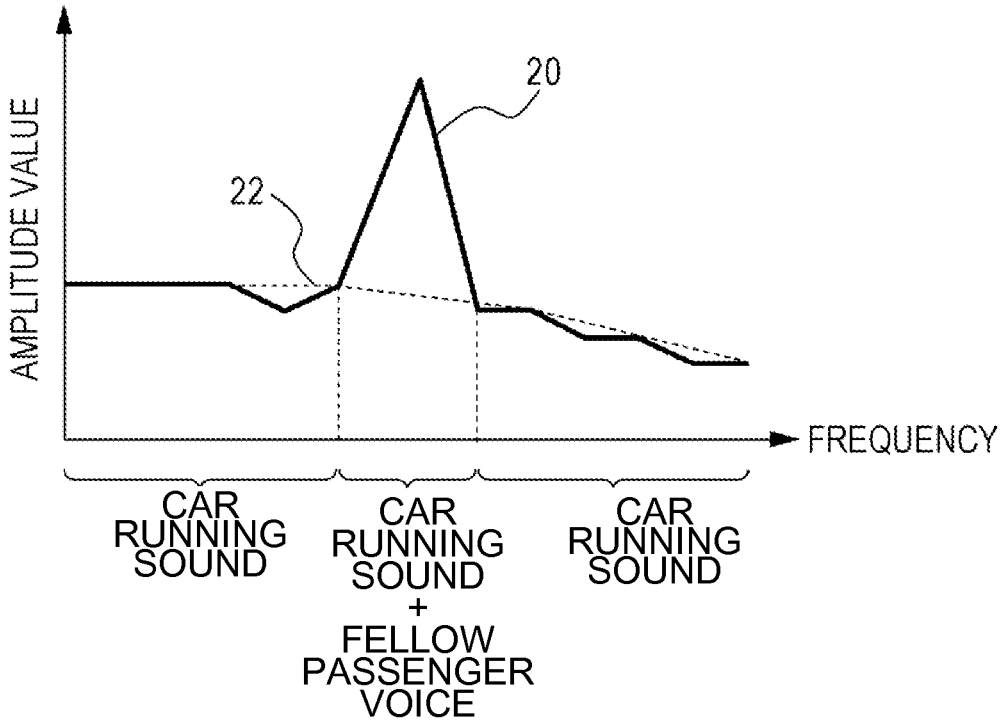
FIG. 2 is a graph illustrating an example of a target value of stationary noise according to the first embodiment.

FIG. 2 is a graph illustrating an example of the target value of stationary noise. In FIG. 2, the abscissa axis represents frequency, and the ordinate axis represents amplitude value. An amplitude spectrum 20 represents an example of the amplitude value of each frequency of a frequency spectrum transformed by the transformation section 5. A target value 22 represents a target value of stationary noise of each frequency estimated by the stationary noise estimation section 7. The target value of stationary noise is calculated, for example, by a related art method, such as a method described in Japanese Laid-open Patent Publication No. 2007-183306, and the like. Assuming that FIG. 2 indicates an example of noise in an automobile telephone, a part in FIG. 2 at which the amplitude value of noise is relatively low is considered to indicate, for example, mainly car running sound. A part in FIG. 2 at which the amplitude value of noise is relatively high is considered to indicate, for example, a voice including car running sound and a voice of a fellow passenger superimposed on each other. In this case, the target value 22 is substantially at the same amplitude value as that of the car running sound, and is a value with which the voice of the fellow passenger is suppressed.

Figure 3:
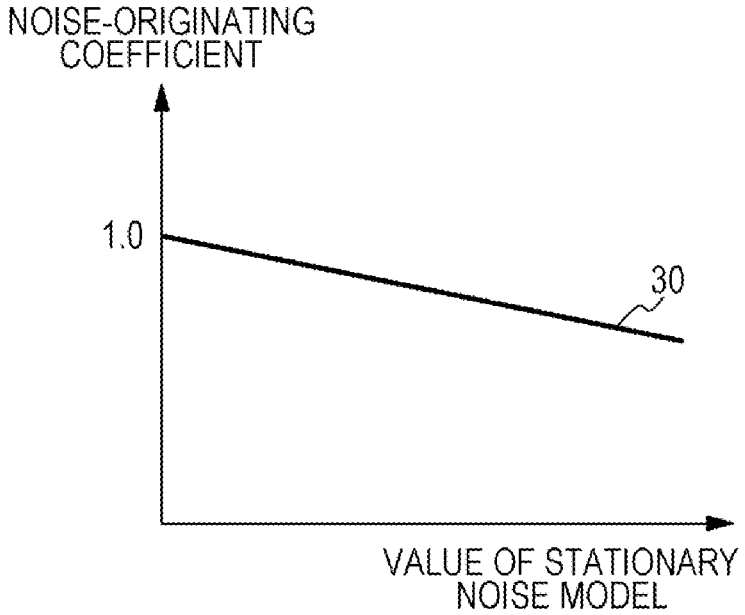
FIG. 3 is a graph illustrating an example of the relationship between a noise-originating coefficient and a value of a stationary noise model according to the first embodiment.

FIG. 3 is a graph illustrating an example of the relationship between a noise-originating coefficient and a value of a stationary noise model. In FIG. 3, the abscissa axis represents the value of the stationary noise model, and the ordinate axis represents the noise-originating coefficient. As illustrated in FIG. 3, a noise-originating coefficient 30 may be a real number of "1" or less, which gradually decreases as the value of the stationary noise model increases. For example, the noise-originating coefficient y may be expressed by Expression 3 below using the value x of the stationary noise model.

$$y = 1.0 - 0.00002x. \quad \text{Expression 3}$$

FIG. 4 is an example of a coefficient calculation table 32. The coefficient calculation table 32 is stored, for example, in the storage section 19. As illustrated in FIG. 4, the coefficient calculation table 32 includes the calculation formula used for calculating the noise-originating coefficient and the constant C. The constant C may be a positive real number of "1" or less. When the constant C=1, the constant C substantially does not exist, and the suppression coefficient is equal to the noise-originating coefficient.

Figure 5:
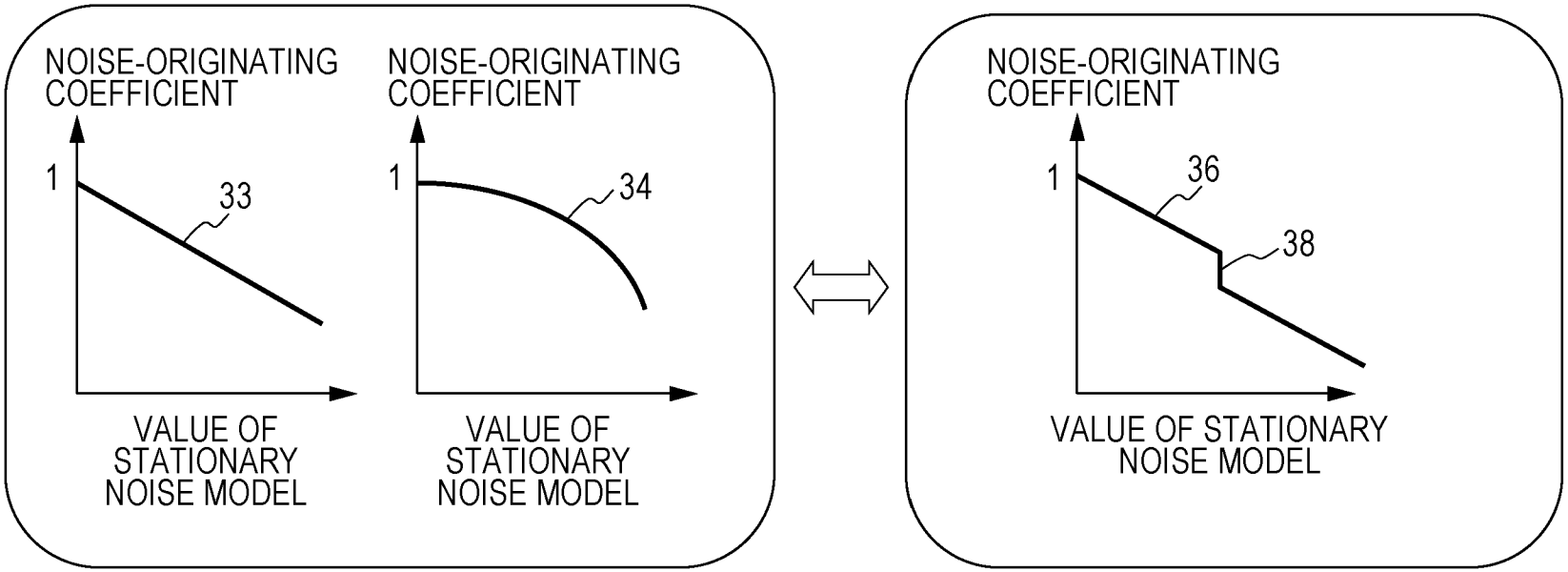
FIG. 5 is a diagram illustrating the relationship of a noise-originating coefficient with a value of a stationary noise model according to the first embodiment.

In this case, details of the noise-originating coefficient will be described. FIG. 5 is a diagram illustrating the relationship of a noise-originating coefficient with a value of a stationary noise model. Each of a noise-originating coefficient 33 and a noise-originating coefficient 34 is a value, of which the maximum is "1" and which "gradually decreases" relative to a value of a stationary noise model. A noise-originating coefficient 36 is an example of a noise-originating coefficient which does not "gradually decreases". In the noise-originating coefficient 36, an inconsistent part 38 at which the noise-originating coefficient 36 inconsistently changes relative to the value of the stationary noise model exists. What is meant by inconsistently changing is that the rate of change in the noise-originating coefficient 36 relative to the value of the stationary noise model rapidly changes. For example, when being represented by a derivative of the rate of change in the noise-originating coefficient 36 relative to the value of the stationary noise model, the noise-originating coefficient 36 does not changes in curved line but changes such that a singularity is included in the change. The voice processing device 1 sets a noise-originating coefficient such that the noise-originating coefficient does not change relative to the value of the stationary noise model as in the inconsistent part 38, or the like, in order not to cause distortion.

Figure 6:
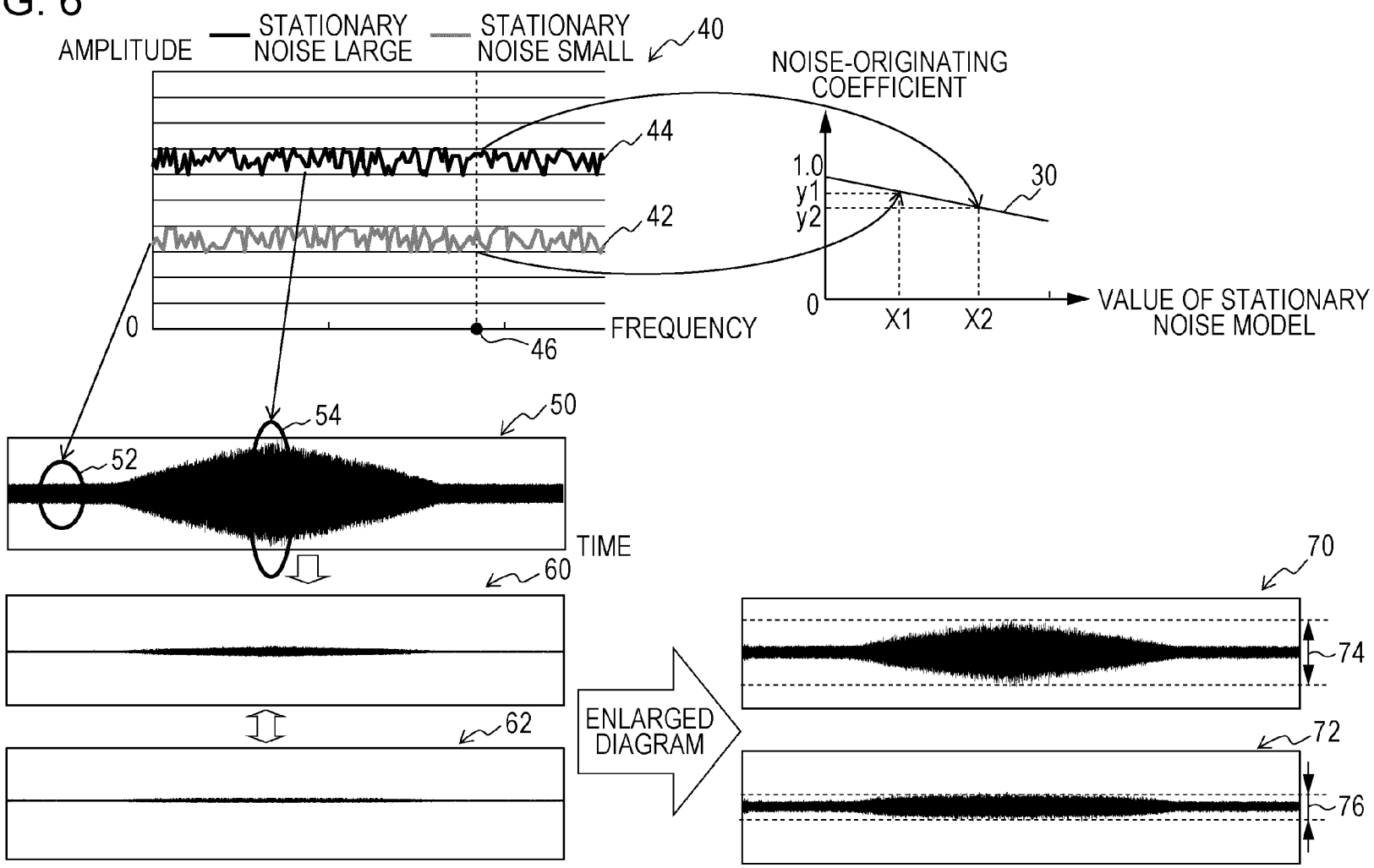
FIG. 6 is a diagram illustrating an action of the noise-originating coefficient according to the first embodiment.

FIG. 6 is a diagram illustrating an effect of the noise-originating coefficient. In FIG. 6, as a stationary noise example 40, an amplitude spectrum 42 and an amplitude spectrum 44 in while noise are illustrated. In the stationary noise example 40, the abscissa axis represents frequency and the ordinate axis represents amplitude value. The amplitude spectrum 42 and the amplitude spectrum 44 are signals obtained by time-frequency transforming a time section 52 and a time section 54 in a voice signal 50. In the voice signal 50, the abscissa axis represents time and the ordinate axis represents amplitude.

In the stationary noise example 40, the value of the stationary noise model differs between the amplitude spectrum 42 and the amplitude spectrum 44 relative to the frequency 46. Referring to these relative to the noise-originating coefficient 30, for the amplitude spectrum 42, the noise-originating coefficient 30=y1 corresponds to the value x1 of the stationary noise model. For the amplitude spectrum 44, the noise-originating coefficient 30=y2 corresponds to the value x2 of the stationary noise mode. In this case, as the value of the stationary noise model increases, the value of the noise-originating coefficient 30 decreases, and thus, noise is suppressed more.

A suppression voice signal 60 represents an example of noise suppression performed when the noise-originating coefficient 30 is not used, that is, when the noise-originating coefficient 30=1. A suppression voice signal 62 represents an example where noise suppression is performed using the noise-originating coefficient 30. A suppression voice signal 70 and a suppression voice signal 72 represent examples where the suppression voice signal 60 and the suppression voice signal 62 are enlarged in the amplitude direction. In each of the suppression voice signals 60, 62, 70, and 72, the abscissa axis represents time and the ordinate axis represents amplitude.

In the example where the noise-originating coefficient 30 is not used, the suppression voice signal 70 has an amplitude 74 after being processed. In the example where the noise-originating coefficient 30 is used, the suppression voice signal 72 has an amplitude 76 after being processed, and the amplitude is reduced to be lower than the amplitude 74. Thus, noise suppression with a greater noise suppression amount and less distortion may be performed on the voice signal 50 by using the noise-originating coefficient 30.

Figure 7:
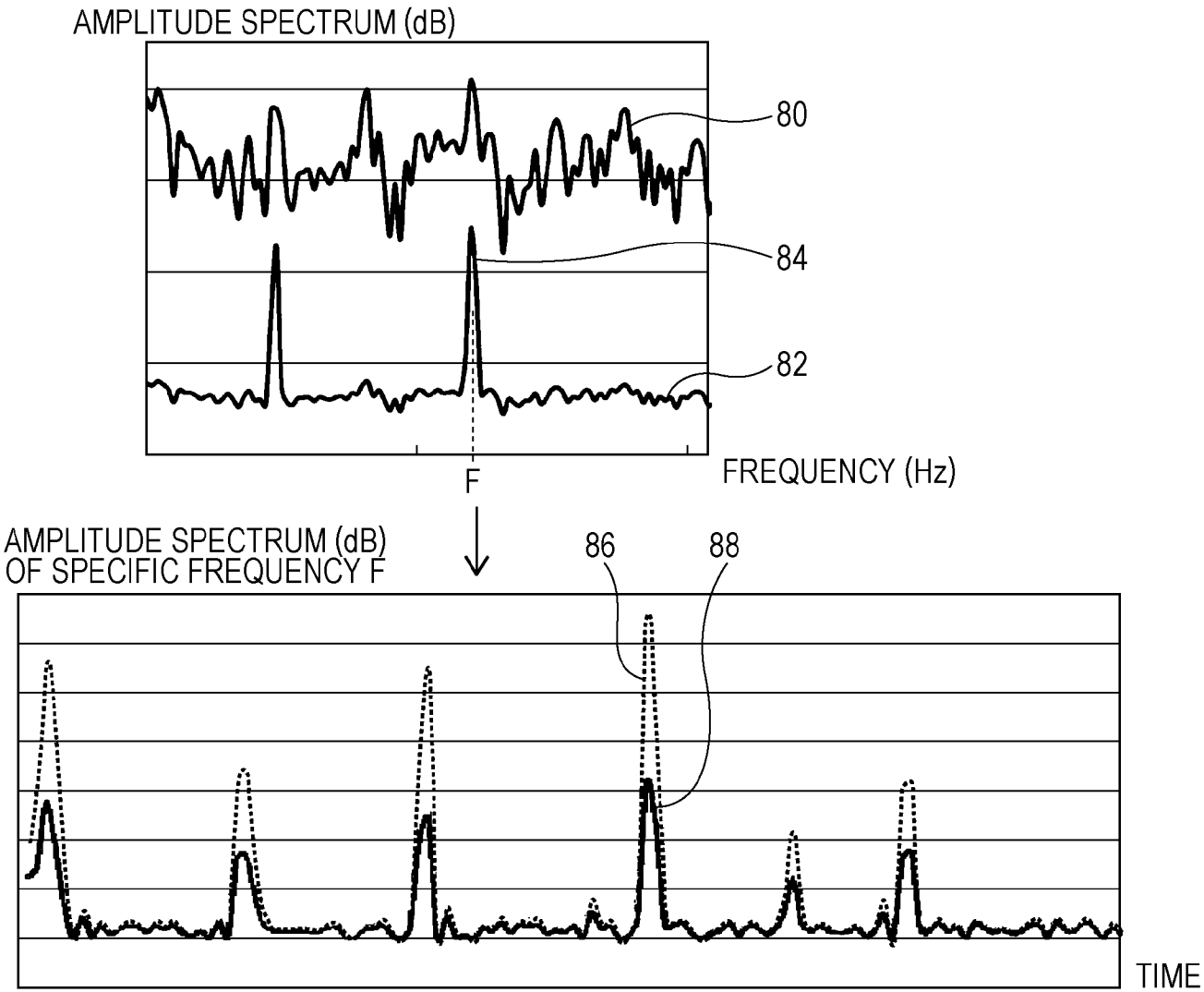
FIG. 7 is a diagram illustrating a phenomenon in which noise distortion reduces according to the first embodiment.

FIG. 7 is a diagram illustrating a phenomenon in which noise distortion reduces. Noise distortion is distortion that occurs in noise in a voice. An amplitude spectrum 80 is an example of an input signal that is a target of noise suppression. A suppression signal 82 is an example of an output signal after being subjected to noise suppression processing. Assuming that the abscissa axis is frequency, the amplitude spectrum 80 and the suppression signal 82 are illustrated. The amplitude spectrum 80 is, for example, an example of a frequency spectrum obtained by transforming an input signal to the voice processing device 1. The suppression signal 82 is, for example, an example of an output signal output when the noise-originating coefficient 30 is not used (the noise-originating coefficient 30=1). In the suppression signal 82, for example, as indicated by a peak 84, an amplitude component in which a noise part remains as a target voice exists near a frequency F.

A suppression voice signal 86 represents an example of change with time of the amplitude spectrum of a component of the suppression signal 82 at the frequency F. A suppression voice signal 88 represents an example of change with time of a component of a signal, noise of which is suppressed using the noise-originating coefficient 30 according to this embodiment, at the frequency F. As comparing the suppression voice signal 86 and the suppression voice signal 88 to each other, it is understood that the change in the amplitude of noise on the time axis is made moderate by using the noise-originating coefficient 30. Thus, noise distortion is reduced.

Figure 8:
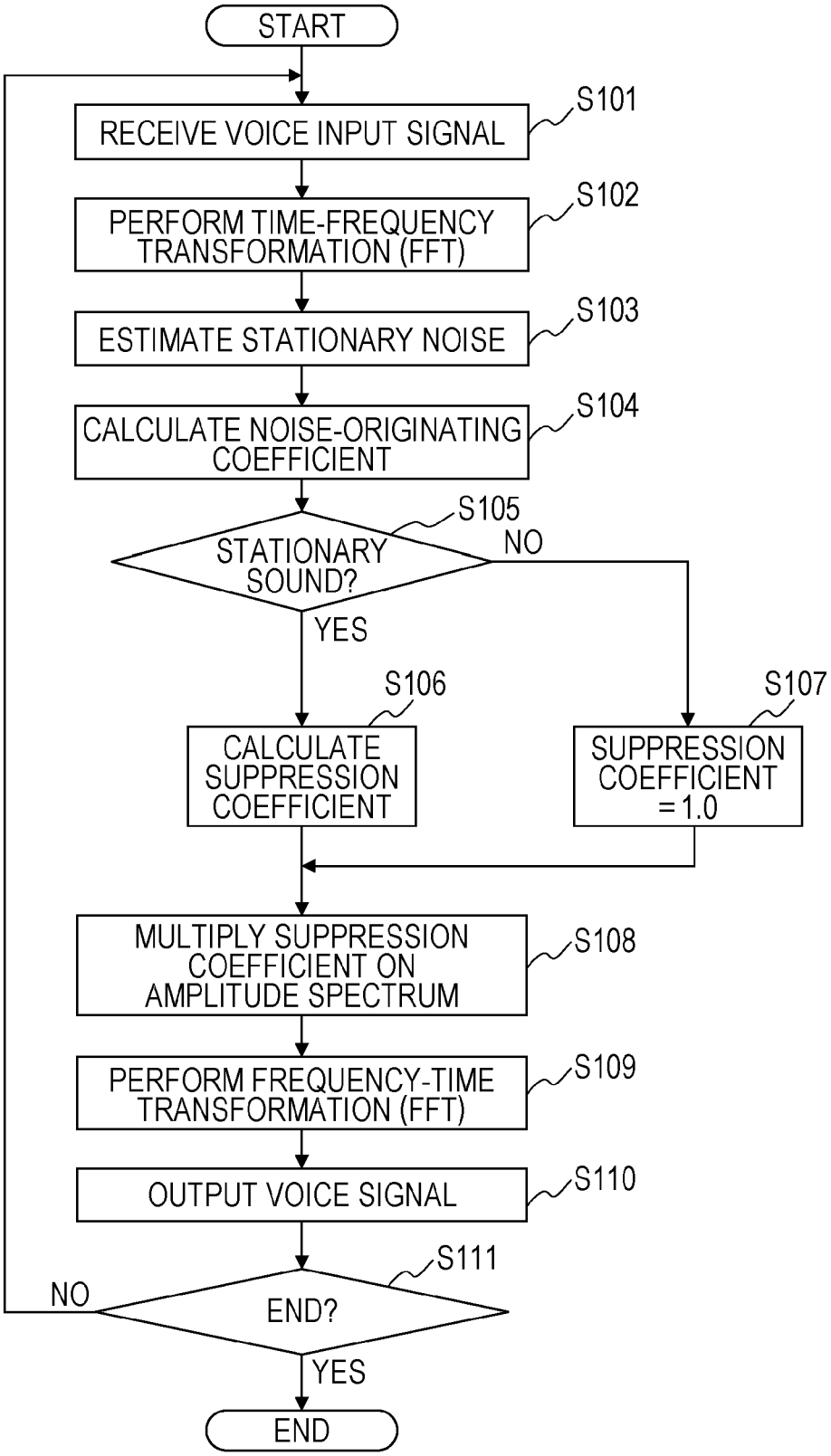
FIG. 8 is a flow chart illustrating the operation of the voice processing device according to the first embodiment.

FIG. 8 is a flow chart illustrating the operation of the voice processing device 1 according to this embodiment. As illustrated in FIG. 8, the voice processing device 1 receives a voice signal (S101). For example, the voice processing device 1 receives a voice signal, which has been converted to an electrical signal by a microphone or the like and digitalized on the time axis.

The transformation section 5 time-frequency transforms the voice signal to output a frequency spectrum (S102). Time-frequency transform is performed, for example, by cutting out a part of the voice signal on the time axis, which corresponds to a predetermined period of time, from the voice signal in chronological order and performing Fast Fourier Transform thereon. The stationary noise estimation section 7 estimates a target value of stationary noise, based on the frequency spectrum (S103). That is, the stationary noise estimation section 7 estimates a value of a stationary noise model for each frequency, based on an amplitude value for each frequency of the frequency spectrum.

The noise-originating coefficient calculation section 11 calculates a noise-originating coefficient y of "1" or less, which gradually decreases as the value of the stationary noise model increases (S104). In this case, for example, the noise-originating coefficient calculation section 11 calculates the noise-originating coefficient y with reference to the coefficient calculation table 32.

The stationary determination section 9 determines, based on the amplitude value for each frequency of the frequency spectrum, whether a component for each frequency is stationary or non-stationary (S105). When it is determined that a frequency component is stationary (YES in S105), the suppression coefficient calculation section 13 multiplies the constant C of "1" or less and the noise-originating coefficient y together to obtain a suppression coefficient (S106). The then suppression coefficient will be also referred to as a stationary noise suppression coefficient. When it is determined that a frequency component is non-stationary (NO in S105), the suppression coefficient calculation section 13 sets "1" as a suppression coefficient (S107).

The suppression signal generation section 15 generates a suppression signal obtained by multiplying the amplitude value for each frequency and the suppression coefficient together (S108). The inverse transformation section 17 frequency-time transforms the suppression signal (S109), and outputs the frequency-time transformed suppression signal (S110). When there is not an input to end a system (NO in S111), the voice processing device 1 repeats the processes in and after S101. When there is an input to end a system (YES in S111), the voice processing device 1 ends processing.

As described above, in the voice processing device 1, the noise-originating coefficient calculation section 11 calculates a noise-originating coefficient that gradually decreases as a target value of stationary noise for each frequency increases, where the target value is calculated based on the amplitude value of a frequency spectrum obtained by time-frequency transforming a voice signal of a predetermined period of time. When it is determined, based on the amplitude value of the frequency spectrum, that the frequency spectrum is stationary, the suppression signal generation section 15 generates a suppression signal by multiplying the amplitude value by a suppression coefficient based on the noise-originating coefficient to be output after frequency-time transforming.

That is, the voice processing device 1 transforms a voice signal on a time axis for a predetermined period of time to a frequency spectrum. The voice processing device 1 estimates a target value of stationary noise for each frequency, based on the amplitude value for each frequency of the frequency spectrum. The voice processing device 1 calculates a noise-originating coefficient of "1" or less, which gradually decreases as the target value increases. The voice processing device 1 multiplies a constant of 1 or less and the noise-originating coefficient together to obtain a suppression coefficient for a frequency component of the frequency spectrum that has been determined to be stationary. The voice processing device 1 sets "1" as a suppression coefficient for a frequency component that has been determined to be non-stationary. The voice processing device 1 generates a suppression signal obtained by multiplying the amplitude value for each frequency and a suppression coefficient together, frequency-time transforms the generated suppression signal, and outputs the frequency-time transformed suppression signal.

As described above, the voice processing device 1 uses the noise-originating coefficient that gradually decreases with increasing target value estimated as a value of stationary noise model. By using the gradually decreasing noise-originating coefficient which is continuous without an inconsistency part based on the estimated value of stationary noise model, increase in noise suppression amount may be realized while reducing distortion that occurs due to noise suppression. Also, by multiplying a signal by the noise-originating coefficient corresponding to the value of the stationary noise model, the noise suppression amount of stationary noise may be increased with increasing value of the stationary noise model, and thus, the amplitude change of a voice signal may be made moderate.

By using a noise-originating coefficient, a frequency component of a frequency spectrum, which is determined to be stationary, is suppressed, and therefore, noise suppression with less distortion may be performed even when noise is large. By using a noise-originating coefficient corresponding to a value of stationary noise model, excessive suppression may be prevented, and noise distortion is reduced. Also, when the component is not determined to be stationary, suppression is not performed, and therefore, a voice is not suppressed as noise, and voice distortion is reduced.

Note that, although a case where whether a frequency component is stationary or non-stationary is determined for each frequency component has been described in the above-described example, the stationary determination section 9 may be configured to perform determination to be stationary or non-stationary for each frame. In this case, the suppression coefficient calculation section 13 preferably calculates a suppression coefficient for a frequency component included in a frame that has been determined stationary, based on Expression 1.

Second Embodiment

A voice processing device 130 according to a second embodiment will be described below with reference to the accompanying drawings. In the voice processing device 130 according to the second embodiment, similar configurations and operations to those of the voice processing device 1 according to the first embodiment are denoted by the same reference characters as the reference characters in the first embodiment and the overlapping description will be omitted.

Figure 9:
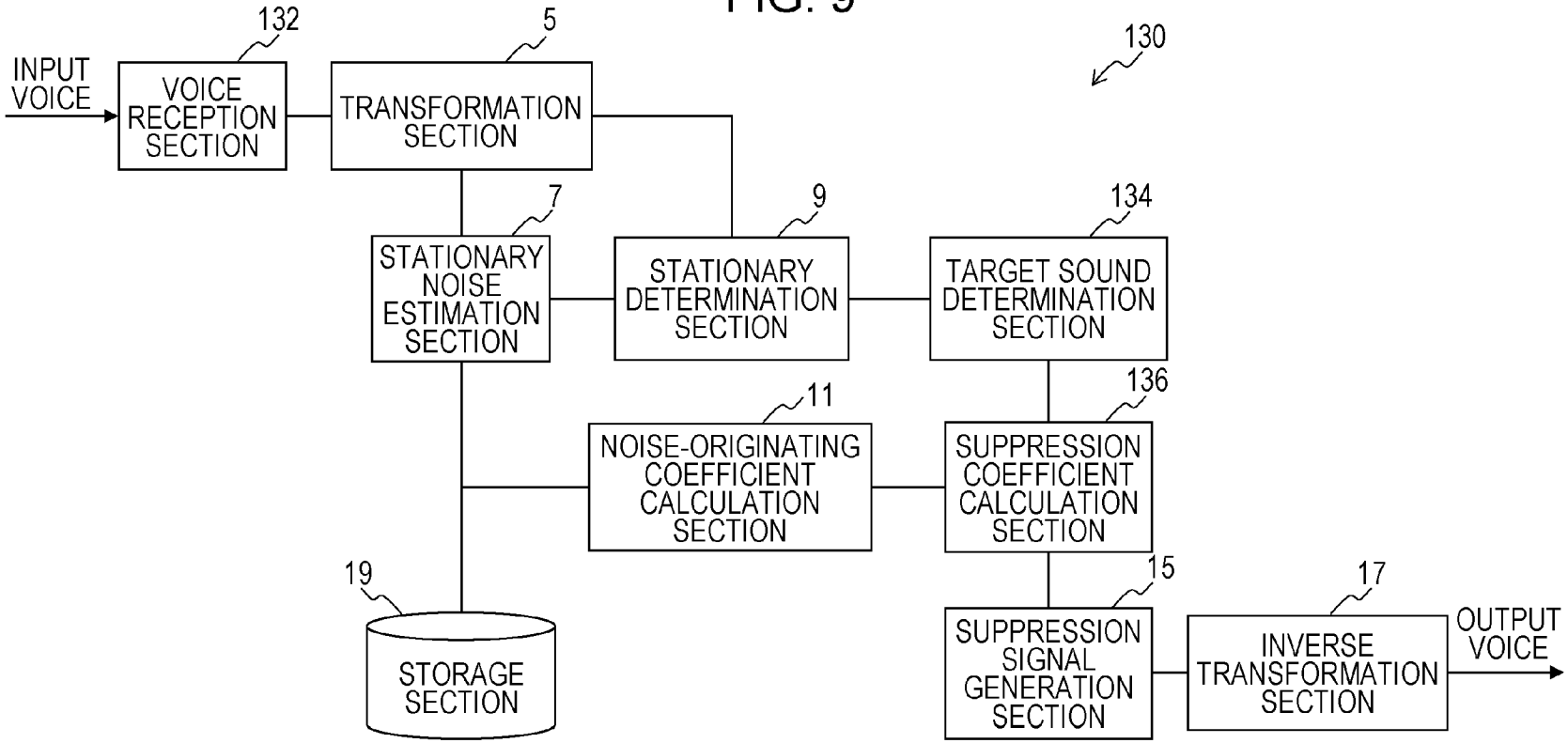
FIG. 9 is a block diagram illustrating an example of a functional configuration of a voice processing device according to a second embodiment.

FIG. 9 is a block diagram illustrating an example of a functional configuration of the voice processing device 130 according to the second embodiment. Similar to the voice processing device 1, the voice processing device 130 includes the transformation section 5, the stationary noise estimation section 7 the stationary determination section 9, the noise-originating coefficient calculation section 11, the suppression signal generation section 15, the inverse transformation section 17, and the storage section 19. The voice processing device 130 further includes a voice reception section 132, a target sound determination section 134, and a suppression coefficient calculation section 136.

The voice reception section 132 receives an analog voice signal as an electrical signal converted, for example, by a microphone, or the like, and digitalizes the received analog voice signal, and outputs the digitaized signal as a voice signal on a time axis. When the stationary determination section 9 determines that a frequency component is stationary, the target voice determination section 134 determines whether or not the determined frequency component is a target sound.

Target sound determination may be performed, for example, by a method in which a target sound is determined as a sound of a frequency at which "the amplitude value of the frequency spectrum/the value of the stationary noise model" is equal to or higher than a threshold because a voice usually has a great amplitude. Using this method, it may be determined whether or not a component for each frequency is a target sound. For example, the threshold is set to be a value that is greater than a maximum value of a voice signal that is considered to include only noise. Using a statistical method, the threshold may be obtained from a plurality of voice signals which have been actually obtained, for example.

Another known method may be applicable to determine whether or not a frequency component is a target sound, for example. Further, a corresponding frequency component may be determined to be a target sound in a case where there is another method, a certain condition is satisfied in the above-described method, or one of the conditions is satisfied.

Similar to the suppression coefficient calculation section 13 according to the first embodiment, for a frequency component that has been determined to be stationary by the stationary determination section 9, the suppression coefficient calculation section 136 calculates a suppression coefficient, based on Expression 1. For a frequency component that has been determined to be a target sound, the suppression coefficient calculation section 136 sets "1" as a suppression coefficient, as expressed by Expression 2. When it is determined that a frequency component is neither stationary nor a target sound, the suppression coefficient calculation section 136 calculates the suppression coefficient, based on Expression 4 below. This suppression coefficient will be also referred to as a non-stationary noise suppression coefficient.

$$\text{Suppression coefficient} = \text{Coefficient } K(f) \times \text{Constant } C \times \text{Noise-originating coefficient } y. \qquad \text{Expression 4}$$

Note that the coefficient K(f) is a coefficient that represents the ratio of the value of the stationary noise model to the corresponding frequency component and a coefficient when the corresponding frequency component is suppressed to the stationary noise model. The coefficient K(f) is calculated, based on the target value estimated by the stationary noise estimation section 7 and each frequency component obtained by performing transformation by the transformation section 5, using Expression 5 below.

$$\text{Coefficient } K(f) = \text{Target value of each frequency (the value of the stationary noise model)/Amplitude value of each frequency component.} \qquad \text{Expression 5}$$

Figure 10:
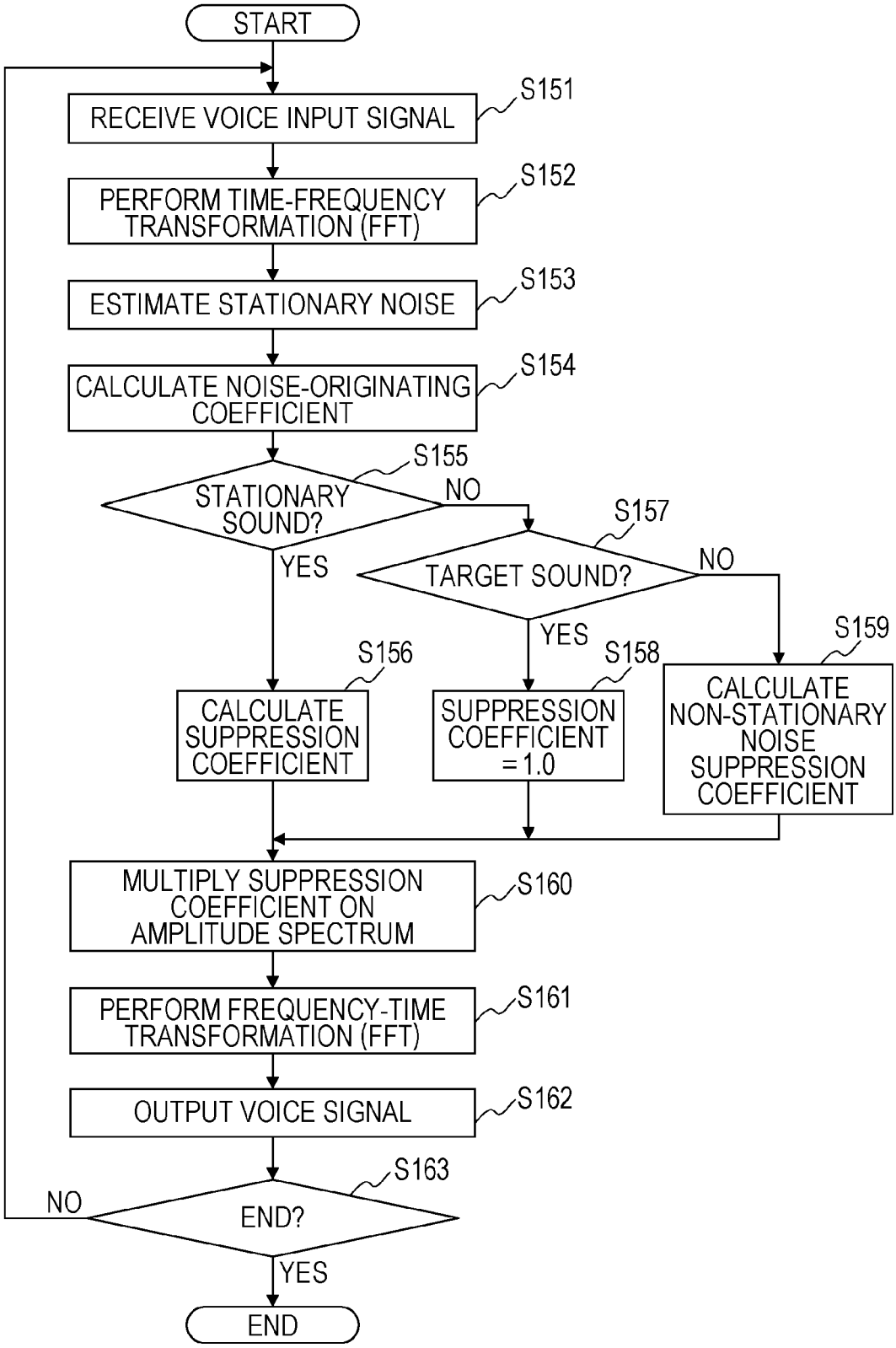
FIG. 10 is a flow chart illustrating the operation of the voice processing device according to the second embodiment.

FIG. 10 is a flow chart illustrating the operation of the voice processing device 130 according to the second embodiment. As illustrated in FIG. 10, the voice processing device 130 receives a voice signal via the voice reception section 132 (S151). For example, the voice reception section 132 receives a voice signal on a time axis as an electrical signal converted by a microphone or the like.

The transformation section 5 time-frequency transforms the voice signal to output a frequency spectrum on a frequency axis (S152). Time-frequency transformation is performed, for example, by cutting out a part of the voice signal on the time axis, which corresponds to a predetermined period of time, from the voice signal, and performing Fast Fourier Transform thereon. The stationary noise estimation section 7 estimates a target value of stationary noise, based on the frequency spectrum (S153). That is, the stationary noise estimation section 7 estimates the value of the stationary noise model for each frequency, based on the amplitude value for each frequency of the frequency spectrum on the frequency axis.

The noise-originating coefficient calculation section 11 calculates a noise-originating coefficient of "1" or less, which gradually decreases as the value of the stationary noise model increases (S154). In this case, for example, the noise-originating coefficient calculation section 11 calculates a noise-originating coefficient y with reference to the coefficient calculation table 32.

The stationary determination section 9 determines, based on the amplitude value for each frequency of the frequency spectrum on the frequency axis, whether a component for each frequency is stationary or non-stationary (S155). When it is determined that a frequency component is stationary (YES in S155), the suppression coefficient calculation section 136 multiplies the constant C of "1" or less by the noise-originating coefficient y to calculate a stationary noise suppression coefficient, based on Expression 1 (S156). When it is determined that a frequency component is non-stationary (NO in S155), the target sound determination section 134 determines whether or not the frequency component is a target sound (S157). When it is determined that the frequency component is a target sound (YES in S157), the suppression coefficient calculation section 136 sets "1" as a suppression coefficient (S158). When it is determined that the frequency component is not a target sound (NO in S157), the suppression coefficient calculation section 136 calculates a non-stationary noise suppression coefficient, based on Expression 4 (S159).

The suppression signal generation section 15 generates a suppression signal obtained by multiplying the amplitude value for each frequency and the suppression coefficient together (S160). The inverse transformation section 17 frequency-time transforms the suppression signal (S161) and outputs the frequency-time transformed suppression signal (S162). When there is not an input to end a system (NO in S163), the voice processing device 130 repeats the processes in and after S151. When there is an input to end a system (YES in S163), the voice processing device 130 ends processing.

FIG. 11 is a diagram illustrating a table as an example of noise suppression effect of the voice processing device 130 according to the second embodiment. As illustrated in FIG. 11, a suppression example 180 is an example in which an average level of noise is higher than that in a suppression example 182 by about 15 dB. In the suppression example 180, as compared to the conventional case where the noise-originating coefficient is not used, a suppression effect with a noise suppression amount of 3.4 dB for stationary noise and 1.7 dB for non-stationary noise is achieved. As for a voice suppression amount, an equivalent effect to the effect of a related art technique is achieved. In the suppression example 182, as compared to the conventional case where the noise-originating coefficient is not used, a suppression effect with a noise suppression amount of 0.4 dB for stationary noise and 0.6 dB for non-stationary noise is achieved. As for a voice suppression amount, an equivalent effect to the effect of a related art technique is achieved. As described above, in noise suppression according to this embodiment, an equivalent effect to the effect of a related art technique is achieved for voice suppression, and there is no increase in distortion. Based on the foregoing, regarding noise suppression, as noise increases, the noise suppression effect increases, as compared to a related art example where a noise-originating coefficient is not used.

As described above, the voice processing device 130 transforms a voice signal on the time axis for a predetermined period of time to a frequency spectrum on the frequency axis. The voice processing device 130 estimates a target value of stationary noise for each frequency, based on an amplitude value for each frequency of the frequency spectrum. The voice processing device 130 calculates a noise-originating coefficient of "1" or less, which gradually decreases as the target value increases. The voice processing device 130 multiplies the constant C of 1 or less and the noise-originating coefficient together to obtain a suppression coefficient for a frequency component of a frequency spectrum, which has been determined to be stationary. For a frequency component determined to be non-stationary, the voice processing device 130 further determines whether or not the frequency component is a target sound. When the frequency component is a target sound, the voice processing device 130 sets "1" as a suppression coefficient, while, when it is determined that the frequency component is not a target sound, the voice processing device 130 calculates a non-stationary noise suppression coefficient. The voice processing device 130 generates a suppression signal obtained by multiplying the amplitude value for each frequency and the suppression coefficient together, frequency-time transforms the generated suppression signal, and outputs the frequency-time transformed suppression signal.

As described above, in the voice processing device 130, similar to the voice processing device 1 according to the first embodiment, a noise-originating coefficient that gradually decreases as a target value calculated as a value of a stationary noise model increases is used. With the noise-originating coefficient, a frequency component of a frequency spectrum, which has been determined to be stationary, is suppressed. Accordingly, noise suppression with less distortion may be enabled even when noise is large. Furthermore, the voice processing device 130 determines, for a frequency component that has been determined to be non-stationary, whether or not the frequency component is a target sound and sets, when the frequency component is a target sound, the suppression coefficient=1 so as not to perform suppression. When the frequency component is not a target sound, the voice processing device 130 performs suppression using a non-stationary noise suppression coefficient. Therefore, in addition to the advantages of the voice processing device 1 according to the first embodiment, it may be enabled to perform noise suppression while further reducing the voice distortion. Specifically, when stationary noise is larger, a greater noise suppression effect may be achieved. As described above, determination to be or not a target sound is performed, and thus, noise may be suppressed by increasing the noise suppression amount and voice distortion may be reduced by reducing a voice suppression amount.

Note that, as a target sound determination method, the following method may be used. That is, the target sound determination section 134 may be configured to determine a target sound when an autocorrelation value between the corresponding frame and a frame before the corresponding frame in the time direction is higher than a threshold, utilizing the fact that a voice has a high autocorrelation and noise has a low autocorrelation. In this case, determination to be or not a target sound is performed on each time frame. Also, the determination may be performed, for example, by the stationary determination section 9, for a frame including a frequency component that has been determined to be non-stationary.

When a target sound is determined for a frame in the above-described manner, the stationary determination section 9 may be configured to determine whether a frequency spectrum is stationary or non-stationary for each frame, based on an amplitude value for each frequency of a frequency spectrum on a frequency axis. Specifically, the stationary determination section 9 may be configured to use, for example, stationary/non-stationary determination described in Japanese Laid-open Patent Publication No. 2010-230814 to determine that the frequency spectrum is non-stationary when the rate of change with time of the amplitude spectrum of the corresponding frame is higher than a threshold, and determine, when the rate of change with time is lower than the threshold, that the frequency spectrum is stationary. As for the rate of change with time, various modified examples, such as a method in which the rate of change with time is calculated for a statistical representative value, such as an average value of the amplitude spectrum of the corresponding frame, and the like, a method in which the rate of change with time is calculated for each frequency component and a statistical representative value is set as the rate of change with time, and the like, may be used. As another method, a method in which, when the statistical representative value of the amplitude spectrum of the corresponding frame is greater than the statistical representative value of the target value of stationary noise of the corresponding frame by a predetermined value or more, it is determined that the frequency spectrum is non-stationary, or the like, may be used. Note that, when determination to be or not stationary is performed on each frame, the suppression coefficient calculation section 13 preferably calculates a stationary noise suppression coefficient for all frequency components in a frame that has been determined to be stationary using Expression 1 described above.

A method in which a target sound is determined for each frame may be used in combination with the above-described method in which a target sound is determined for each frequency. For example, the target sound determination section 134 may be configured to determine, only when a target sound is determined by both of the above-described determination methods, that the frequency component is a target sound. As another option, the target sound determination section 134 may be configured to determine, when a target sound is determined by either one of the above-described methods, that the frame or the frequency component is a target sound.

Third Embodiment

A voice processing device 200 according to a third embodiment will be described below with reference to the accompanying drawings. In the voice processing device 200 according to the third embodiment, similar configurations and operations to those of the voice processing device 1 according to the first embodiment and the voice processing device 130 according to the second embodiment are denoted by the same reference characters as the reference characters in the first embodiment and the second embodiment, and the overlapping description will be omitted.

Figure 12:
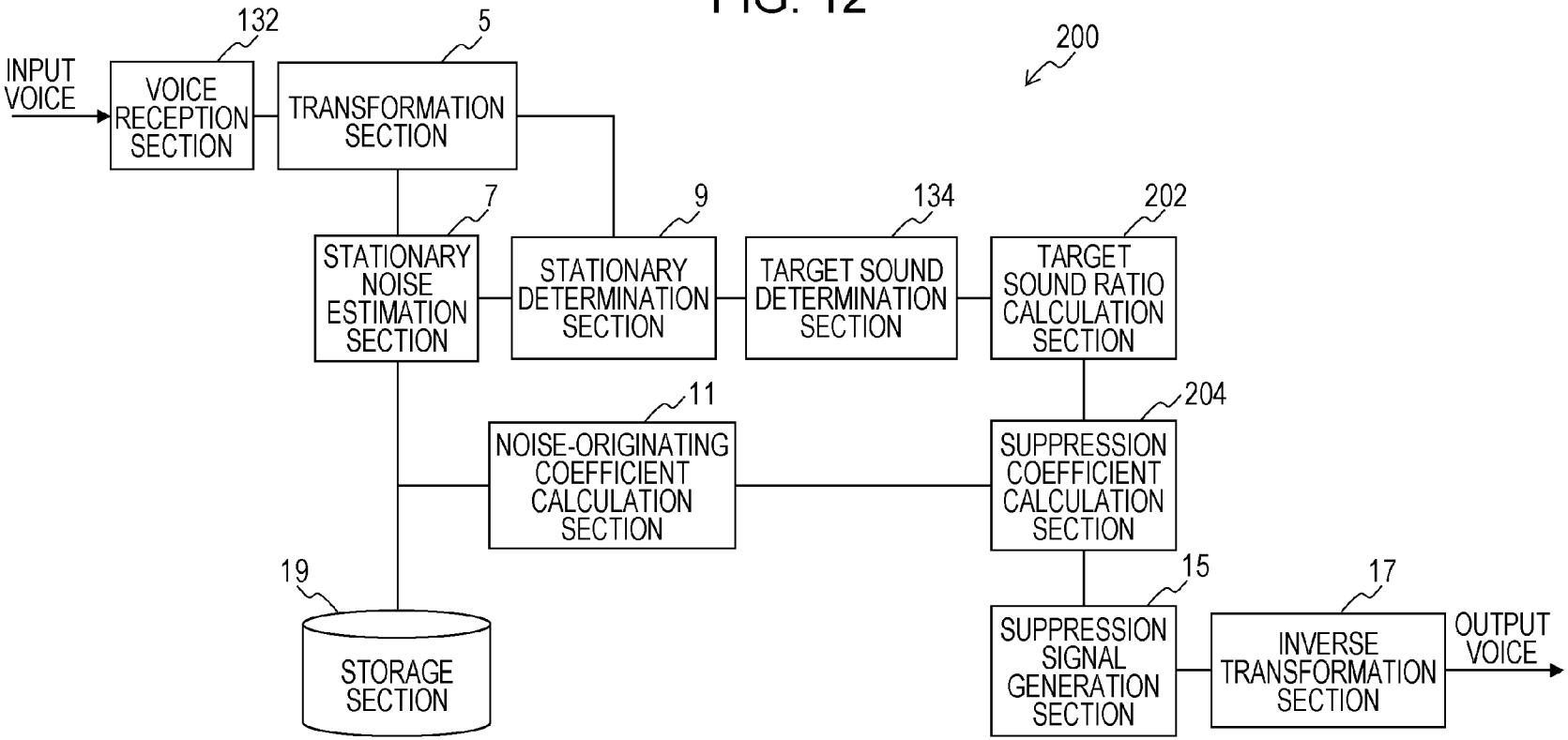
FIG. 12 is a block diagram illustrating an example of a functional configuration of a voice processing device according to a third embodiment.

FIG. 12 is a block diagram illustrating an example of a functional configuration of the voice processing device 200 according to the third embodiment. Similar to the voice processing device 1 and the voice processing device 130, the voice processing device 200 includes the transformation section 5, the stationary noise estimation section 7, the stationary determination section 9, the noise-originating coefficient calculation section 11, the suppression signal generation section 15, the inverse transformation section 17, and the storage section 19. Furthermore, similar to the voice processing device 130, the voice processing device 200 includes the voice reception section 132 and the target sound determination section 134. The voice processing device 200 further includes a target sound ratio calculation section 202 and a suppression coefficient calculation section 204.

The target sound ratio calculation section 202 calculates a target sound ratio for each predetermined period time extracted by the transformation section 5, that is, for each temporal frame. The target sound ratio is expressed by Expression 6 below, assuming that an FFT length is the number of frequency components in one frame.

Target sound ratio=The number of frequencies that have been determined to be a target sound in one frame/FFT length. Expression 6

Similar to the suppression coefficient calculation section 13 and the suppression coefficient calculation section 136, the suppression coefficient calculation section 204 calculates, based on Expression 1, a suppression coefficient for a frequency component that has been determined to be stationary by the stationary determination section 9. For a frequency component that has been determined to be a target sound, the suppression coefficient calculation section 204 sets "1" as a suppression coefficient, as expressed by Expression 2. When a frequency component is determined to be neither stationary nor non-stationary, the suppression coefficient calculation section 204 calculates a suppression coefficient in accordance with the target sound ratio.

FIG. 13 is a table illustrating an example of the sound ratio-based coefficient data table 210. As illustrated in FIG. 13, a sound ratio-based coefficient data table 210 is a data table in which a calculation formula of a suppression coefficient in accordance with each target sound ratio, and first and second predetermined values are stored. The calculation formula is a formula used for calculating a suppression coefficient for each of three levels in accordance with the corresponding target sound ratio.

In the sound ratio-based coefficient data table 210, when the target sound ratio is equal to or larger than a first predetermined value Th1 set in advance (that is, when the target sound ratio is high), the suppression coefficient is calculated by Expression 4, similar to the non-stationary suppression coefficient calculated in the voice processing device 130 according to the second embodiment. For the sake of convenience, Expression 4 is described again below.

Target sound ratio (high): Suppression coefficient=Coefficient $K(f)$×Constant $C$×Noise-originating coefficient $y$. Expression 4

When the target sound coefficient is less than the first predetermined value Th1 and is equal to or greater than a second predetermined value Th2, which is smaller than the first predetermined value Th1 (that is, when the target sound ratio is intermediate), the suppression coefficient is calculated by Expression 7 below. When the target sound ratio is less than the second predetermined value Th2 (that is, when the target sound ratio is low), the suppression coefficient is calculated by Expression 8 below.

Target sound ratio (intermediate): Suppression coefficient=Coefficient $K(f)$×Constant $C$. Expression 7

Target sound ratio (low): Suppression coefficient=Coefficient $K(f)$. Expression 8

Note that the target sound ratio may be calculated for several voice signals obtained in advance, for example, in a state where noise is small, and then, the first predetermined value Th1 and the second predetermined value Th2 may be determined based on the degree of a distribution of the calculated target sound ratio.

Figure 14:
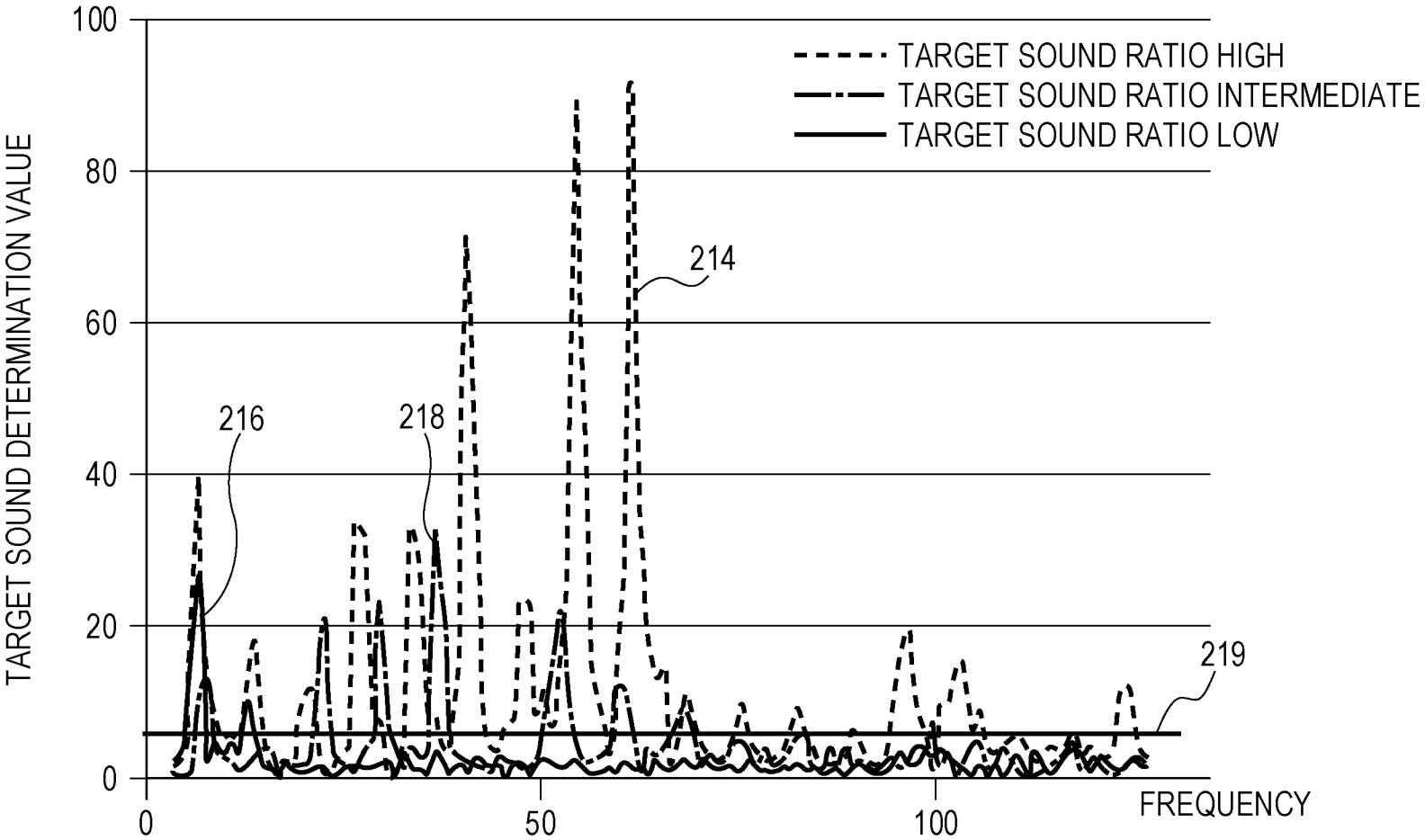
FIG. 14 is a diagram illustrating frequency dependency of a target sound determination value according to the third embodiment.

FIG. 14 is a graph illustrating frequency dependency of a target sound determination value. Note that the target sound determination value is "an amplitude value of a frequency spectrum/a value of a stationary noise model". Also, a threshold 219 is a threshold used for determining whether or not the corresponding frequency component is a target sound, based on the target sound determination value. When the target sound determination value exceeds the threshold 219, it is determined that the frequency component is a target sound.

As illustrated in FIG. 14, a target sound determination value 214 represents an example of the target sound determination value when it is determined that the target sound ratio is high. A target sound determination value 216 represents an example of the target sound determination value when it is determined that the target sound ratio is intermediate. A target sound determination value 218 represents an example of the target sound determination value when it is determined that the target sound ratio is low. As described above, it is determined that a frequency component having the target sound determination value that exceeds a threshold 219 is a target sound. Also, the target sound ratio is determined in accordance with the number of frequency components that are determined to be a target sound.

Figure 15:
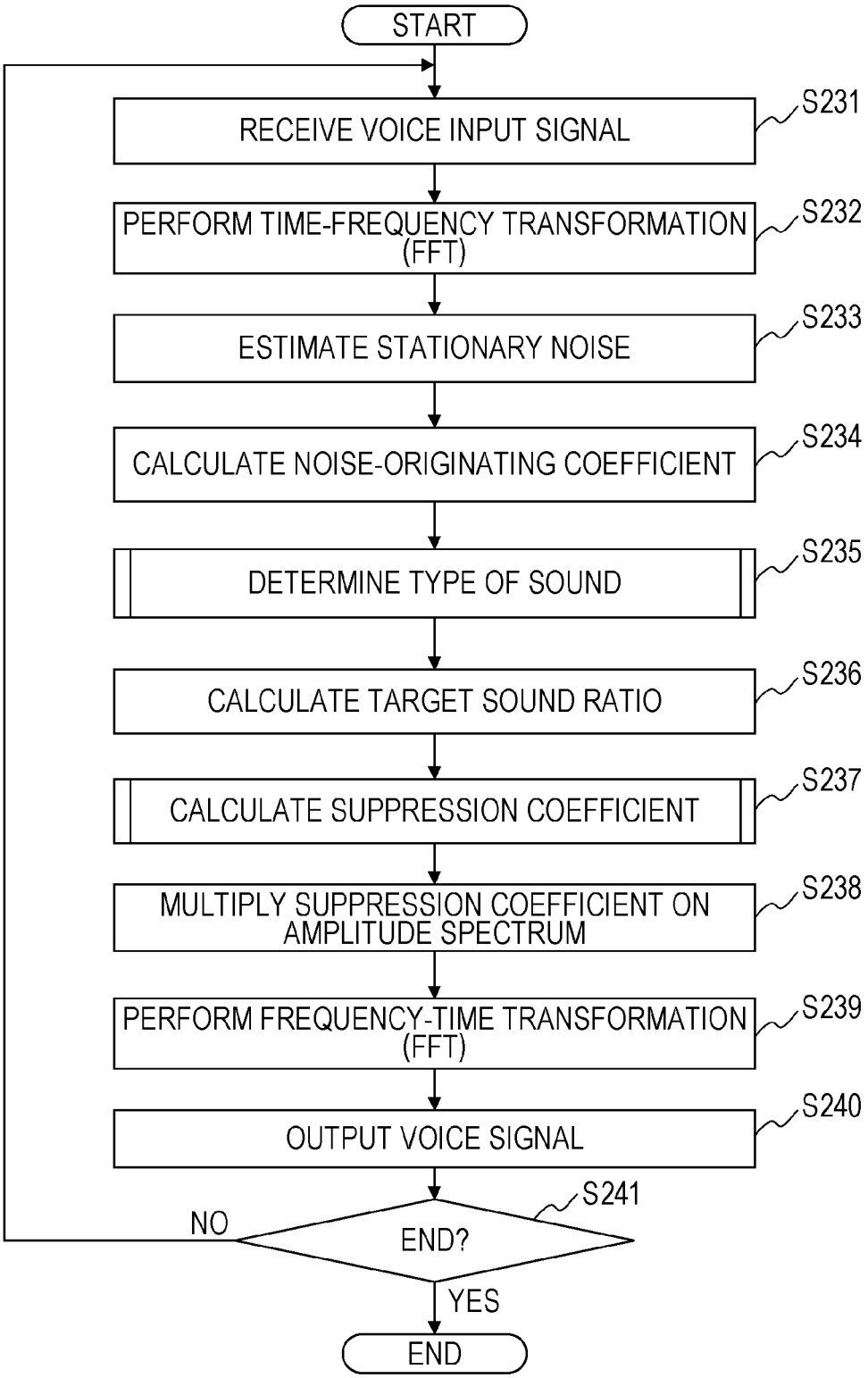
FIG. 15 is a flow chart illustrating an operation of the voice processing device according to the third embodiment.
Figure 16:
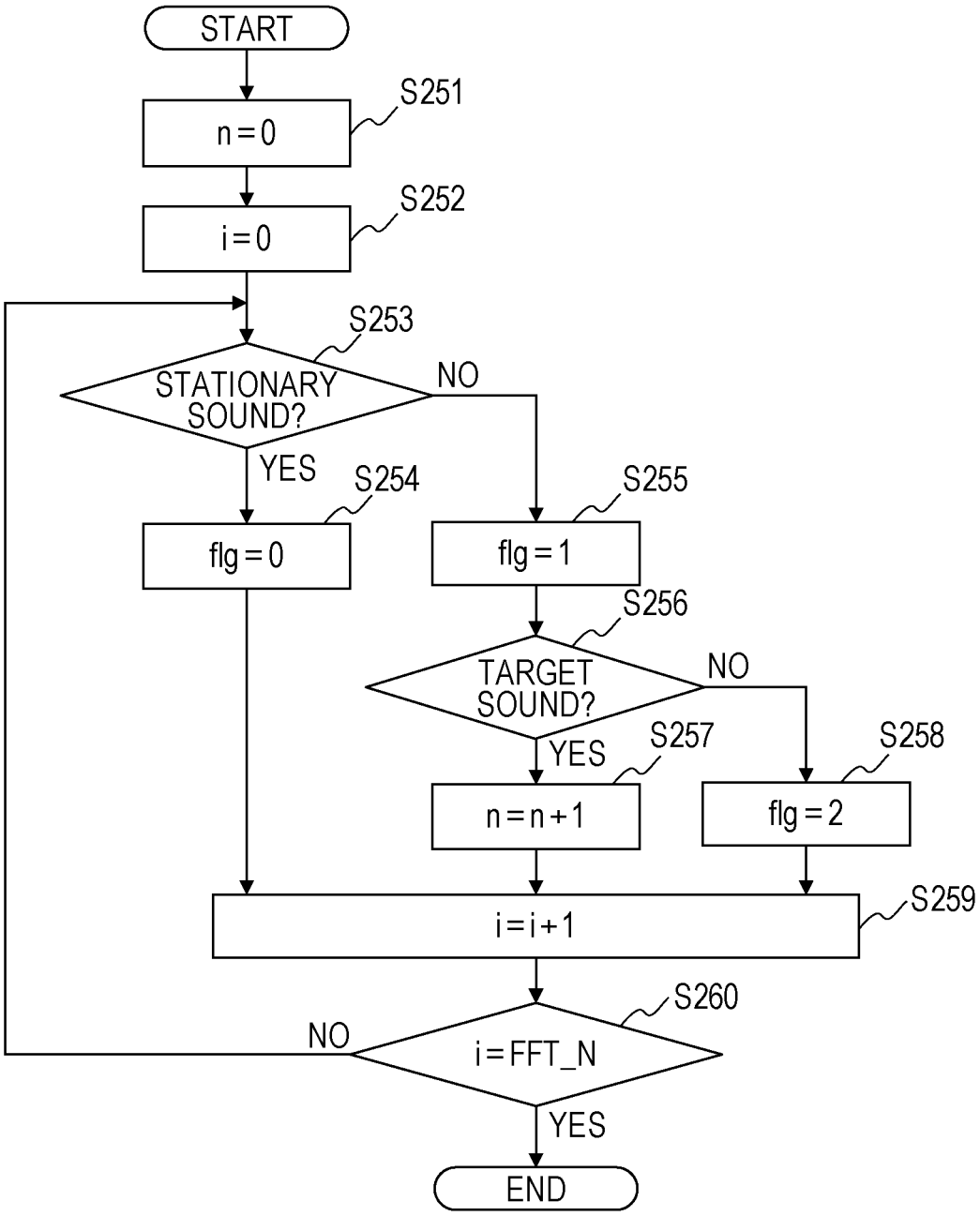
FIG. 16 is a flow chart illustrating details of sound type determination processing according to the third embodiment.
Figure 17:
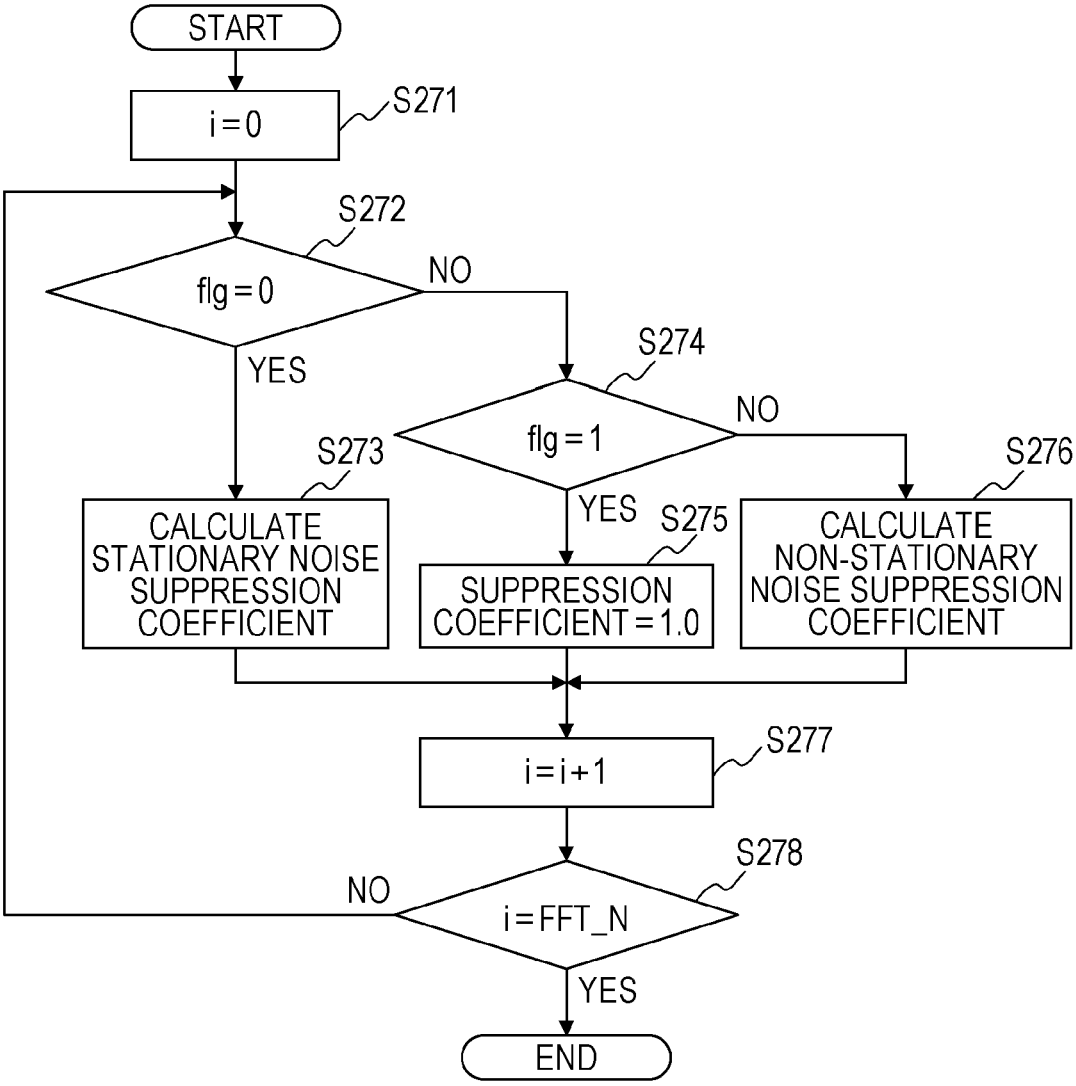
FIG. 17 is a flow chart illustrating details of suppression coefficient calculation processing according to the third embodiment.

FIG. 15 is a flow chart illustrating an operation of the voice processing device 200 according to the third embodiment. FIG. 16 is a flow chart illustrating details of sound type determination processing. FIG. 17 is a flow chart illustrating details of suppression coefficient calculation processing.

As illustrated in FIG. 15, the voice processing device 200 receives a voice signal at the voice reception section 132 (S231). For example, the voice processing device 200 receives a voice signal on a time axis, which has been converted to an electrical signal via a microphone or the like.

The transformation section 5 time-frequency transforms the voice signal and outputs a frequency spectrum on a frequency axis (S232). Time-frequency transformation is performed, for example, by cutting out a part of the voice signal on the time axis, which corresponds to a predetermined period of time, from the voice signal, and performing Fast Fourier Transform thereon. The stationary noise estimation section 7 estimates a target value of stationary noise, based on the frequency spectrum (S233). That is, the stationary noise estimation section 7 estimates a value of a stationary noise model for each frequency, based on an amplitude value for each frequency of the frequency spectrum on the frequency axis.

The noise-originating coefficient calculation section 11 calculates a noise-originating coefficient of "1" or less, which gradually decreases as the value of the stationary noise model increases (S234). In this case, for example, the noise-originating coefficient calculation section 11 calculates a noise-originating coefficient y with reference to the coefficient calculation table 32.

The stationary determination section 9 determines, based on the amplitude value for each frequency of the frequency spectrum on the frequency axis, whether a component for each frequency is stationary or non-stationary. Also, the target sound ratio calculation section 202 determines whether or not the component for each frequency is a target sound (S235). Details of the process in the S235 will be described later. The target sound ratio calculation section 202 calculates a target sound ratio (S236). That is, based on a result of sound type determination which will be described later, the target sound ratio calculation section 202 calculates a target sound ratio for each frame. The suppression coefficient calculation section 204 calculates a suppression coefficient for each frequency (S237). Details of suppression coefficient calculation processing will be described later.

The suppression signal generation section 15 generates a suppression signal obtained by multiplying an amplitude value for each frequency and the suppression coefficient together (S238). The inverse transformation section 17 frequency-time transforms the suppression signal (S239), and outputs the frequency-time transformed suppression signal (S240). When there is not an input to end a system (NO in S241), the voice processing device 200 repeats the processes in and after S231. When there is an input to end a system (YES in S241), the voice processing device 200 ends processing.

Next, sound type determination processing will be described with reference to FIG. 16. In the following processing, a variable n is a variable used for counting the number of frequency components that are determined to be a target sound. A variable i is a variable used for counting the number of frequency components which have been determined whether each of the frequency components is a target sound or not. A flag fig is a flag that indicates a sound type of the corresponding frequency component, the flag fig is "0" when the frequency component is stationary, the flag fig is "1" when the frequency component is a target sound, and the flag flg is "2" when the frequency component is neither stationary nor a target sound. A constant FFT_N is an FFT length.

As illustrated in FIG. 16, the stationary determination section 9 sets n=0 (S251). The stationary determination section 9 sets i=0 (S252). The stationary determination section 9 determines, for one of frequency components, whether or not the frequency component is stationary sound (S253). When the frequency component is a stationary sound (YES in S253), the stationary determination section 9 sets flg=0 for the frequency component (S254). When it is determined that the frequency component is not stationary sound in S253 (NO in S253), the stationary determination section 9 sets flg=1 for the frequency component (S255).

The target sound determination section 134 determines, for a frequency component that has been determined to be not stationary sound, whether or not the frequency component is a target sound (S256). When it is determined that the frequency component is a target sound (YES in S256), the target sound determination section 134 sets n=n+1 (S257). When it is determined that the frequency component is not a target sound (NO in S256), the target sound determination section 134 sets flg=2 (S258).

In S259, the stationary determination section 9 sets i=i+1 (S259), when the variable i is not the FFT length FFT_N (NO in S260), the process returns to S253 to repeat the process. When the variable i is the number of frequency components in one frame=FFT_N (YES in S260), the stationary determination section 9 ends sound type determination processing, and the process returns to the process illustrated in FIG. 15. Note that, in S236, the target sound ratio calculation section 202 calculates the target sound ratio=n/FFT_N.

Subsequently, details of suppression coefficient calculation processing will be described with reference to FIG. 17. As illustrated in FIG. 17, the suppression coefficient calculation section 204 sets i=0 (S271). For one of frequency components, when flg=0 (YES in S272), the suppression coefficient calculation section 204 calculates a stationary noise suppression coefficient (S273). That is, when it is determined that the frequency component is stationary in S253, the suppression coefficient calculation section 204 multiplies the constant C of "1" or less and the noise-originating coefficient y together, based on Expression 1, to calculate the stationary noise suppression coefficient (S273).

When flg=1 (NO in S272, YES in S274), the suppression coefficient calculation section 204 sets the suppression coefficient=1. When flg=2 (NO in S274), the suppression coefficient calculation section 204 calculates a non-stationary noise suppression coefficient (S276). That is, the suppression coefficient calculation section 204 calculates the non-stationary noise suppression coefficient for each frequency component, bade on the target sound ratio calculated in the process illustrated in FIG. 16, with reference to the sound ratio-based coefficient data table 210. The suppression coefficient calculation section 204 sets i=i+1 (S277), and repeats the processes in and after S272 until i=FET_N is satisfied (NO in S278). When i=FFT_N (YES in S278) is satisfied, the suppression coefficient calculation section 204 causes the process to return to the process illustrated in FIG. 15.

As described in detail above, the voice processing device 200 according to the third embodiment performs noise suppression in accordance with a target sound ratio. The target sound ratio is calculated in accordance with the ratio of the frequency component that is determined to be a target sound in each frame. When the target sound ratio is high, a suppression coefficient is calculated such that non-stationary noise in the corresponding frame is further suppressed.

As described above, with the voice processing device 200 according to the third embodiment, in addition to the advantages of the voice processing device 1 according to the first embodiment and the voice processing device 130 according to the second embodiment, noise suppression in accordance with a target sound ratio may be advantageously performed on a non-stationary noise portion. For example, even when determination to be a target sound or a non-voice sound that is not a target voice is performed, the accuracy of determination is not 100%, and therefore, when noise is mistakenly determined as a target sound, the suppression amount might drastically vary in the time direction. This causes drastic change in amplitude and then a noise distortion. However, by performing noise suppression in a stepwise fashion in accordance with the target sound ratio, even such a noise distortion may be reduced.

Note that, in the third embodiment, the target sound ratio is divided into three levels, but the target sound ratio is not limited thereto. A case where the target sound ratio is divided into more levels or less levels is construed to be in the range of modification of noise suppression according to this embodiment.

Fourth Embodiment

A voice processing device 300 according to a fourth embodiment will be described below with reference to the accompanying drawings. In the voice processing device 300 according to the fourth embodiment, similar configurations and operations to those in the first to third second embodiments are denoted by the same reference characters as the reference characters in the first to third embodiments, and the overlapping description will be omitted.

Figure 18:
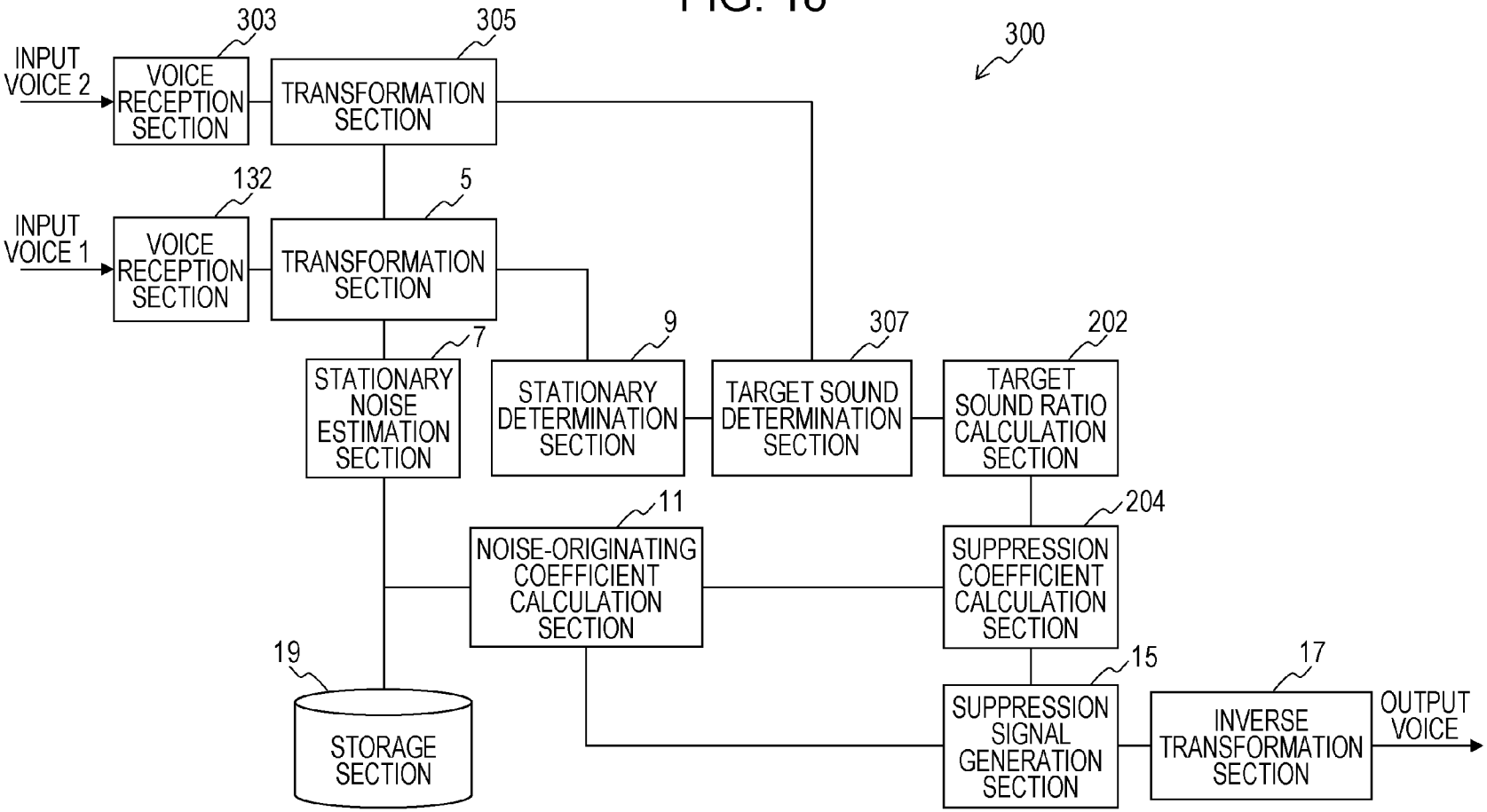
FIG. 18 is a block diagram illustrating an example of a functional configuration of a voice processing device according to a fourth embodiment.

FIG. 18 is a block diagram illustrating an example of a functional configuration of the voice processing device according to the fourth embodiment. Similar to the voice processing device 1, the voice processing device 130, and the voice processing device 200, the voice processing device 300 includes the transformation section 5, the stationary noise estimation section 7, the stationary determination section 9, the noise-originating coefficient calculation section 11, the suppression signal generation section 15, the inverse transformation section 17, and the storage section 19. Furthermore, similar to the voice processing device 200, the voice processing device 300 includes the voice reception section 132, the target sound ratio calculation section 202, and the suppression coefficient calculation section 204. In addition, the voice processing device 300 includes a voice reception section 303, a second transformation section 305, and a target sound determination section 307.

In the voice processing device 300, instead of the target sound determination section 134 in the second embodiment and the third embodiment, the target sound determination section 307 performs determination to be or not a frequency component is a target sound. The voice processing device 300 receives two voice signals. The voice reception section 132 receives one of the voice signals. The voice reception section 303 receives the other one of the voice signals. The two voice signals are signals of voices obtained at different places (spatial positions) at the same time. The two voice signals may be, for example, signals based on voices collected by two microphones placed at different positions. The second transformation section 305 transforms a voice signal from the voice reception section 303 to a frequency spectrum on a frequency axis.

The target sound determination section 307 determines, based on a phase difference or an amplitude ratio between two frequency spectrums, whether or not the corresponding frequency component is a target sound is determined. When the phase difference is used, whether or not the phase difference between the two frequency spectrums is a value that indicates the direction of a target sound is determined. That is, the target sound determination section 307 calculates a phase difference between the two frequency spectrums for each frequency, and determines whether or not the calculated phase difference is included in the range of the phase difference that is possible in the direction of a predetermined sound source.

Figure 19:
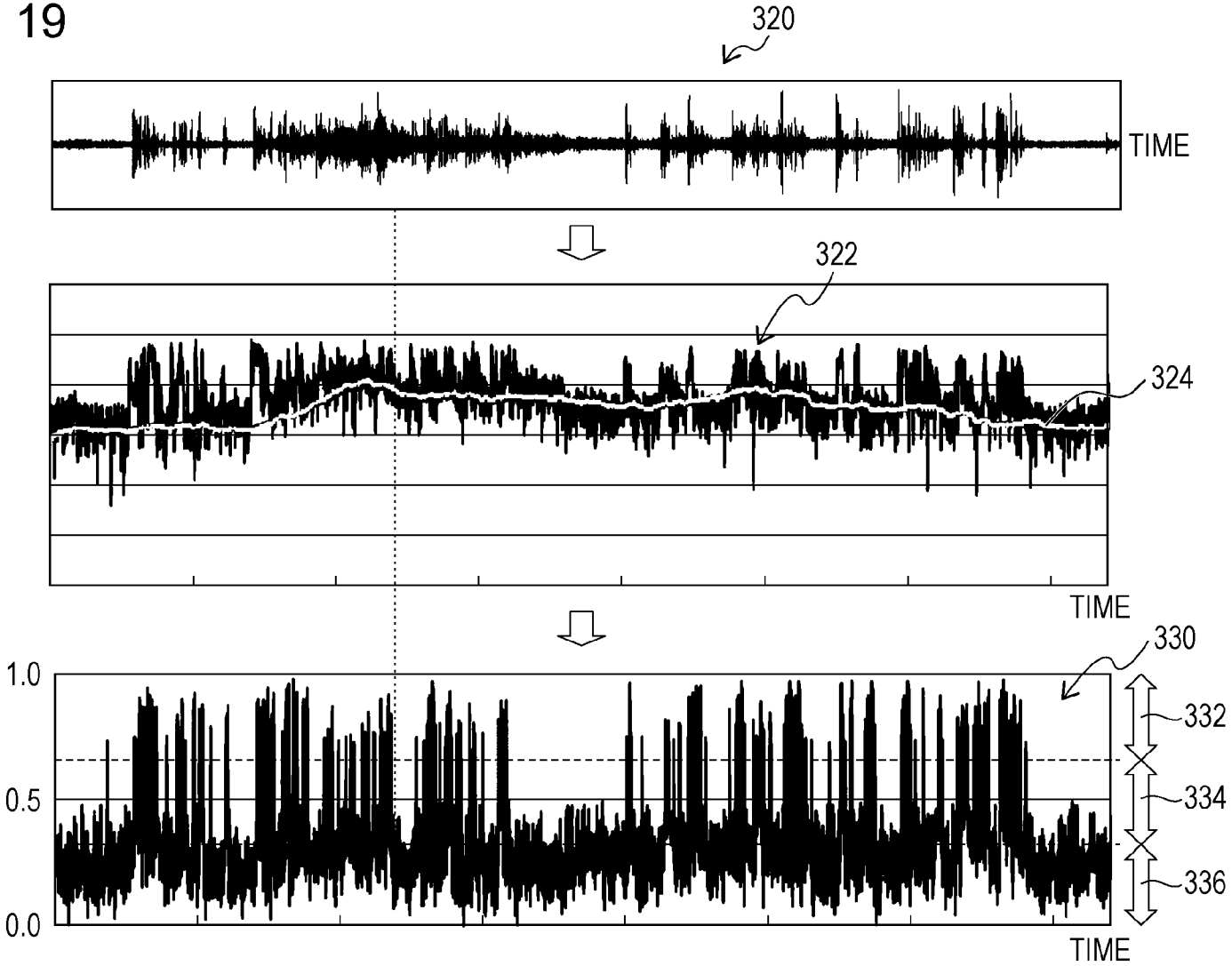
FIG. 19 is a diagram illustrating an example of target voice ratio calculation using two voice signals according to the fourth embodiment.

FIG. 19 is a diagram illustrating an example of target voice ratio calculation using two voice signals. In FIG. 19, assuming that the abscissa axis represents time, a voice signal 320, a signal amplitude 322, and a target sound ratio 330 are illustrated. The voice signal 320 represents the waveform of a voice signal received by the voice reception section 132. The signal amplitude 322 represents change with time of the amplitude of the voice signal near a specific frequency in the voice signal 320. A stationary noise model 324 is a value of a stationary noise model, which has been calculated from the signal amplitude 322. The target sound determination section 307 performs determination depending on whether or not a phase difference from one of the frequency spectrums indicates the direction of the target sound with reference to the value of the same frequency component of the other one of the frequency spectrums similarly calculated. A target sound ratio 330 illustrates an example where, based on the above-described determination, the target sound ratio for each frame is calculated in a similar manner to that in the third embodiment and is represented as change with time. The target sound ratio 330 is illustrated assuming that the ordinate axis is the target sound ratio. In the example of the target sound ratio 330, for example, when the target sound ratio 330 is in a high target sound ratio area 332, a suppression coefficient is calculated by Expression 4. When the target sound ratio 330 is in an intermediate target sound ratio area 334, the suppression coefficient is calculated by Expression 7. When the target sound ratio 330 is in a low target sound ratio area 336, the suppression coefficient is calculated by Expression 8.

Figure 20:
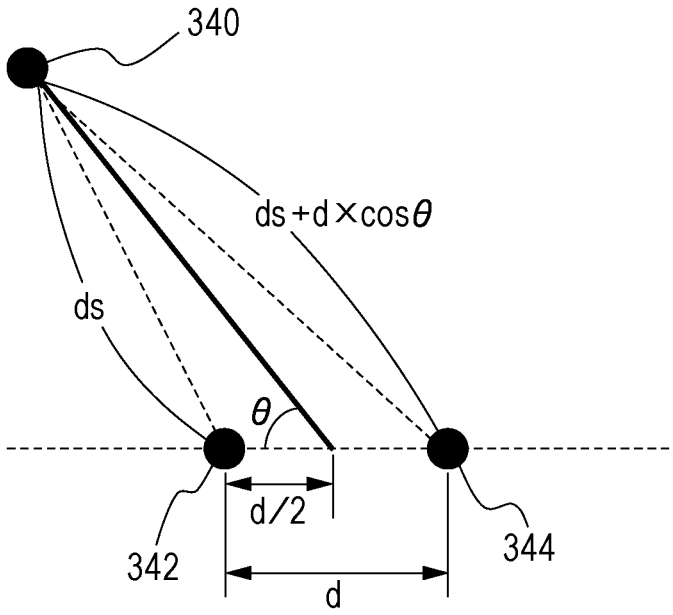
FIG. 20 is a diagram illustrating an example of the positional relationship between two microphones and a sound source according to the fourth embodiment.
Figure 21:
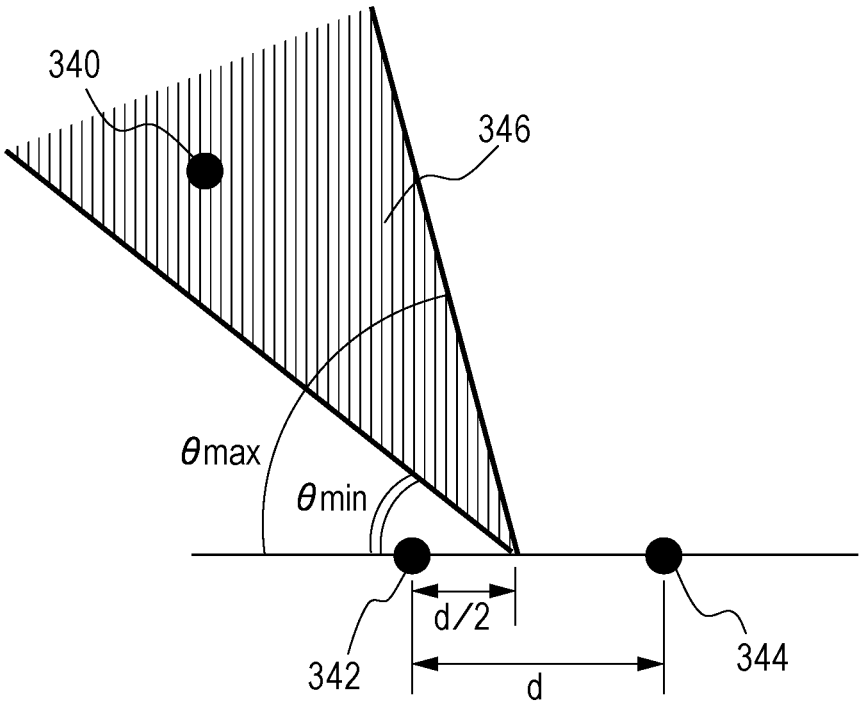
FIG. 21 is a diagram illustrating an example of the direction of a sound source desired to be saved according to the fourth embodiment.

FIG. 20 is a diagram illustrating an example of the positional relationship between two microphones and a sound source. FIG. 21 is a diagram illustrating an example of the direction of a sound source desired to be saved. In FIG. 20, relative to a sound source 340, a microphone 342 and a microphone 344 are provided at positions that are separated from each other with a distance d therebetween. A direction extending from an intermediate point between the microphone 342 and the microphone 344 toward the sound source 340 is a direction that makes an angle θ with a straight line connecting the two microphones 342 and 344. Also, a distance between the microphone 342 and the sound source 340 is a distance ds. In this case, an amplitude spectrum ratio Ra between the microphone 342 and the microphone 344 is expressed by Expression 9.

$$Ra=(ds/(ds+d\times\cos\theta))(0\leq\theta\leq180). \quad \text{Expression 9}$$

In FIG. 21, for example, when the direction of a sound source that is desired not to be suppressed but to be saved is in an area 346 from an angle θmin to θmax, the amplitude spectrum ratio R has a range expressed by Expression 10.

$$R\min \leq R \leq R\max R\min = ds/(ds+d\times\cos\theta\min) R\max = ds/(ds+d\times\cos\theta\max). \quad \text{Expression 10}$$

When a frequency component has an amplitude spectrum ratio that satisfies Expression 10, the target sound determination section 307 determines the frequency component to be a target sound.

Note that, in this embodiment, the target sound ratio calculation section 202 calculates a target sound ratio using the number of frequency components that have been determined to be a target sound based on a phase difference or the amplitude ratio between two frequency spectrums.

Figure 22:
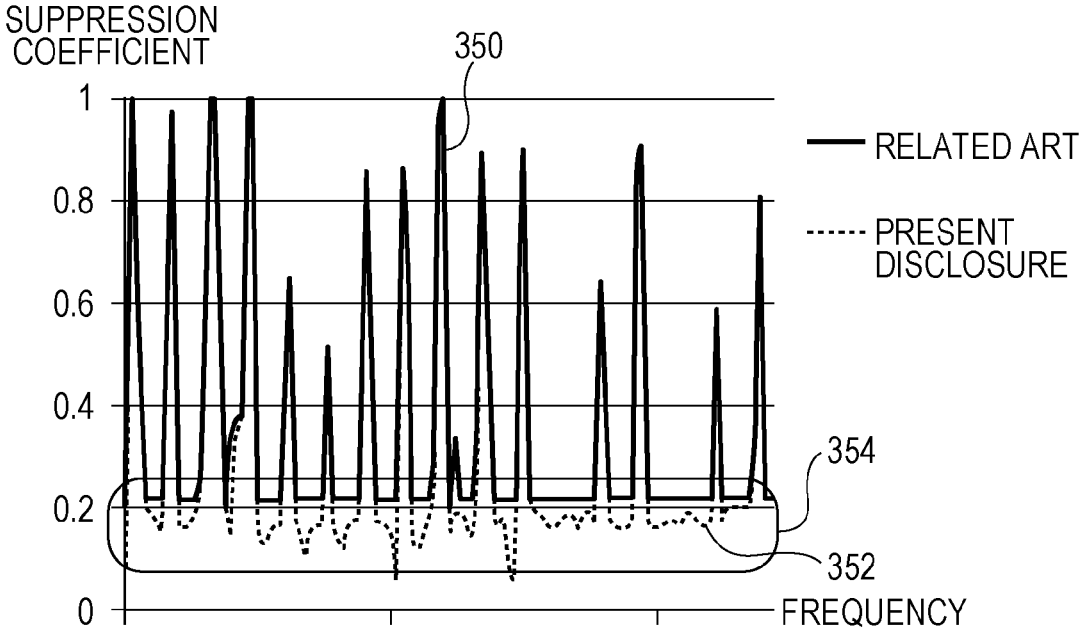
FIG. 22 is a graph illustrating an example of a noise suppression coefficient when it is determined a target sound ratio is high according to the fourth embodiment.

FIG. 22 is a graph illustrating an example of a noise suppression coefficient when it is determined that a target sound ratio is high. In FIG. 22, the abscissa axis represents frequency and the ordinate axis represents suppression coefficient. As illustrated in FIG. 22, a suppression coefficient 350 indicates an example where a noise-originating coefficient is not used. A suppression coefficient 352 indicates an example of a suppression coefficient according to this embodiment. As understood when looking at a small suppression coefficient area 354, a suppression coefficient that is smaller than that in a related art example is calculated as a suppression coefficient according to this embodiment, and noise may be suppressed more.

As described in detail above, in this embodiment, the target sound determination section 307 determines whether or not a frequency component is a target sound, based on a phase difference or an amplitude ratio between two voice signals, depending on whether or not the direction of a sound source indicates the direction of a target sound. Thus, when the direction of a sound source is defined, determination of a target sound may be performed using two voice signals collected at the same time. The voice processing device 300 according to the fourth embodiment may achieve similar advantages to those of voice processing device 200 according to the third embodiment. Furthermore, the direction of a sound source that is desired to be saved as a voice may be specified, and thus, noise suppression may be performed.

Modified Example

Figure 23:
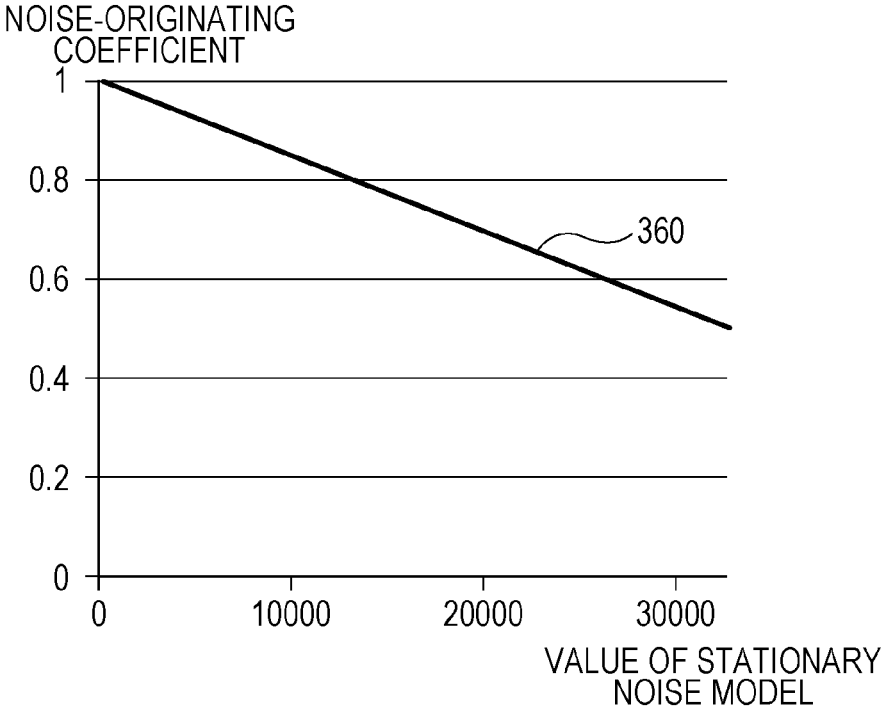
FIG. 23 is a diagram illustrating an example of the relationship of the noise-originating coefficient with the value of the stationary noise model.
Figure 24:
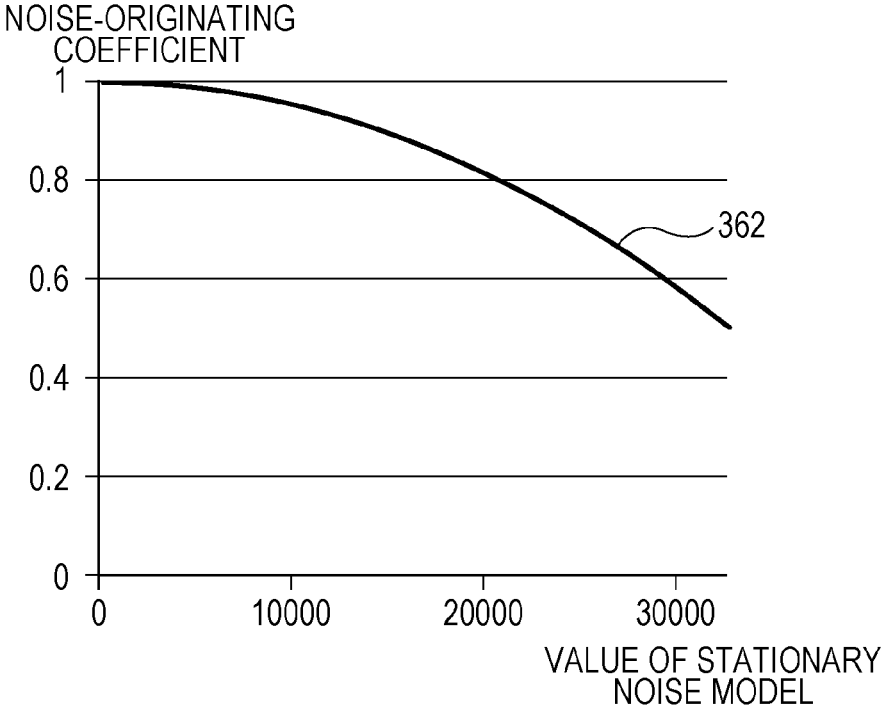
FIG. 24 is a graph illustrating another example of the relationship of the noise-originating coefficient with the value of the stationary noise model.

A modified example of a noise-originating coefficient will be described. FIG. 23 and FIG. 24 are graphs each illustrating an example of the relationship of a noise-originating coefficient with the value x of a stationary noise model. In FIG. 23 and FIG. 24, the abscissa axis represents the value x of the stationary noise model, and the ordinate axis represents the noise-originating coefficient y. Note that the value x of the stationary noise model is an example when the maximum of amplitude=32768. The noise model coefficient y is adjusted such that, when the suppression amount is increased by about 6 dB at the maximum. The value x of the stationary noise model and the value of the noise-originating coefficient y are mere examples, and are not limited thereto.

In the example of FIG. 23, for example, a noise-originating coefficient 360 indicating the relationship between the noise-originating coefficient y and the value x of the stationary noise model is expressed by Expression 11 below.

$$y=1.0ax(a=1.53\times10^{-5}). \quad \text{Expression 11}$$

In the example of FIG. 24, for example, a noise-originating coefficient 362 indicating the relationship between the noise-originating coefficient y and the value x of the stationary noise model is expressed by Expression 12 below.

$$y=1.0bx^2(b=4.66\times10^{-10}). \quad \text{Expression 12}$$

As illustrated in FIG. 23 and FIG. 24, each of the noise-originating coefficient 360 and the noise-originating coefficient 362 is a value that gradually decreases as the value x of the stationary noise model increases. Also, the noise-originating coefficient 362 is set such that, when the value x of the stationary noise model is large, the suppression amount is larger, as compared to the noise-originating coefficient 360. The noise-originating coefficient 360 or the noise-originating coefficient 362 may be applied to each of the first to fourth embodiments. The noise-originating coefficient y may be calculated by another calculation formula in which the noise-originating coefficient y, which is similarly set, gradually decreases.

As described above, the noise-originating coefficient 360 or the noise-originating coefficient 362 according to this modified example is applied to any one of the first to fourth embodiments, and thus, similar to the advantages of each of the embodiments, noise suppression that does not cause a distortion may be performed. With the noise-originating coefficient 362, as compared to a case where the noise-originating coefficient 360 is used, the noise suppression amount may be advantageously further increased when the value x of the stationary noise model is large.

Figure 25:
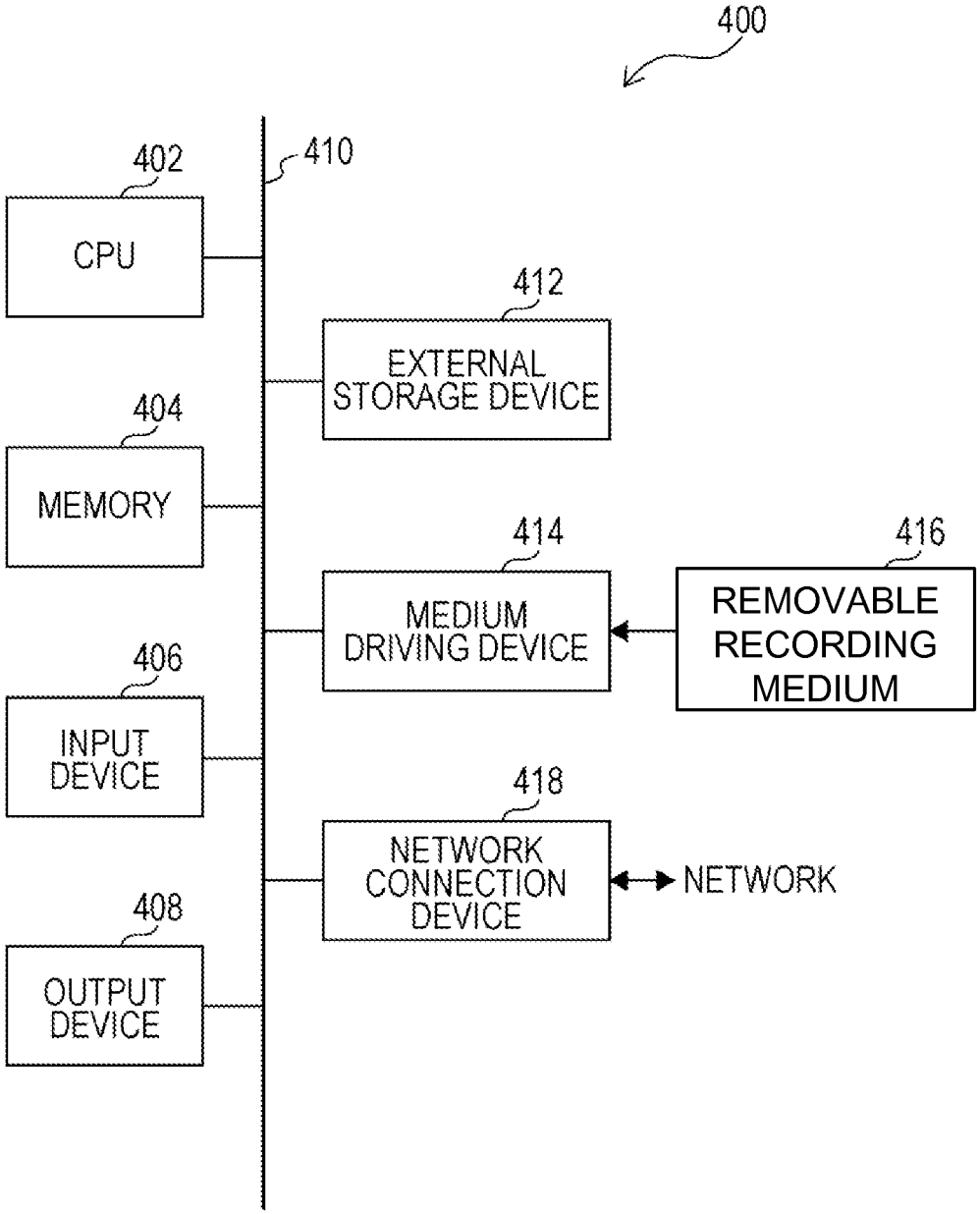
FIG. 25 is a block diagram illustrating an example of a hardware configuration of a standard computer.

An example of a computer commonly used in order to cause the computer to execute the operation of each of noise suppression methods according to the first to fourth embodiments and the modified example will be described below. FIG. 25 is a block diagram illustrating an example of a hardware configuration of a standard computer. As illustrated in FIG. 25, a computer 400 is configured such that a central processing unit (CPU) 402, a memory 404, an input device 406, an output device 408, an external storage device 412, a medium driving device 414, a network connection device 418, and the like, are connected together via a bus 410.

The CPU 402 is an arithmetic processing unit that controls the operation of the entire control section 400. The memory 404 is a storage section that stores a program that controls the operation of the control section 400 in advance and is used as a working area, as appropriate, when a program is executed. The memory 404 is, for example, a random access memory (RAM), a read only memory (ROM), or the like. The input device 406 is a device that obtains, when being operated by a user of the computer, inputs of various types of information from the user, which are associated to the contents of the operation, and sends the obtained input information to the CPU 402, and is, for example, a keyboard device, a mouse device, or the like. The output device 408 is a device that outputs a result of processing executed by the control section 400 and includes a display device or the like. For example, the display device displays a text and an image in accordance with display data sent by the CPU 402.

The external storage device 412 is, for example, a storage device, such as a hard disk, a flash memory, and the like, which stores various types of control programs that are executed by the CPU 402, obtained data, and the like. The medium driving device 414 is a device that writes and reads data to and from a removable recording medium 416. The CPU 402 may be configured to read out a predetermined control program stored in the removable recording medium 416 via the medium driving device 414 to execute the predetermined control program and thereby perform various types of control processing. The removable recording medium 416 is for example, a compact disc (CD)-ROM, a digital versatile disc (DVD), a universal serial bus (USB) memory, or the like. The network connection device 418 is an interface device that performs management of wired or wireless communication of various types of data with an external device. The bus 410 is a communication path which connects the above-described devices together and through which data is communicated.

Programs that cause a computer to execute the noise suppression methods according to the first to fourth embodiments are stored, for example, in the external storage device 412. The CPU 402 reads out a program from the external storage device 412 to cause the control section 400 to perform the operation of noise suppression. In this case, first, a control program used for causing the CPU 402 to perform the operation of noise suppression is generated and is stored in the external storage device 412. Then, a predetermined instruction is given to the CPU 402 from the input device 406 to cause the CPU 402 to read out the control program from the external storage device 412 and execute the control program. As another option, the programs may be stored in the removable recording medium 416.

Note that the present disclosure is not limited to the above-described embodiments, and various configurations and embodiments may be employed without departing from the gist of the present disclosure. For example, the first to fourth embodiments and the modified example are not limited to the description above, but may be combined as long as it is logically possible to combine them.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various changes, substitutions, and alterations could be made hereto without departing from the spirit and scope of the invention.

What is claimed is:

1. A voice processing device comprising:

at least one processor; and at least one memory which stores a plurality of instructions, which when executed by the at least one processor, cause the at least one processor to execute:

obtaining a frequency spectrum by time-frequency transforming a voice signal for a predetermined period of time;

determining an amplitude value of the obtained frequency spectrum;

calculating a target value based on the amplitude value;

after the target value is calculated, calculating a noise-originating coefficient that gradually and consistently decreases as the target value of stationary noise for each frequency increases;

generating, when the frequency spectrum is determined as being stationary on the basis of the amplitude value, a suppression signal by multiplying a suppression coefficient based on the noise-originating coefficient by the amplitude value, the suppression signal being frequency-time transformed to be output; and outputting the generated suppression signal to a speaker.

2. The voice processing device according to claim 1, wherein the at least one processor further executes:

determining, when a component of each frequency of the frequency spectrum is determined to be non-stationary on the basis of the amplitude, whether or not the component of each frequency is a target sound; and when the component of each frequency is determined to be not a target sound, setting, as the suppression coefficient, a coefficient based on a value obtained by multiplying the noise-originating coefficient by a stationary noise coefficient in accordance with the amplitude value and the target value.

3. The voice processing device according to claim 2, wherein the at least one processor further executes:

determining whether or not a component of a predetermined frequency is a target value, based on at least one of an amount of change in the amplitude of each frequency, a ratio between the target value and the amplitude value, and a difference between the target value and the amplitude value.

4. The voice processing device according to claim 2, wherein the at least one processor further executes:

calculating a target sound ratio that indicates a ratio of the target sound in the frequency spectrum; and when the component of each frequency is determined to be not a target sound in the frequency spectrum, setting, as the suppression coefficient, a value calculated in accordance with the target sound ratio.

5. The voice processing device according to claim 4, wherein the at least one processor further executes:

when the target sound ratio is a first predetermined value or more, setting, as the suppression coefficient, a coefficient based on a value obtained by multiplying the noise-originating coefficient and the stationary noise coefficient together.

6. The voice processing device according to claim 5, wherein the at least one processor further executes:

when the target sound ratio is less than the first predetermined value and is equal to or greater than a second predetermined value that is smaller than the first predetermined value, setting, as the suppression coefficient, a value based on the stationary noise coefficient.

7. The voice processing device according to claim 6, wherein the at least one processor further executes:

when the target sound ratio is less than the second predetermined value, setting, as the suppression coefficient, the stationary noise coefficient.

8. The voice processing device according to claim 1, wherein the at least one processor further executes:

determining whether or not a component of each frequency is a target sound, based on at least one of a difference in amplitude of the frequency spectrum and an another frequency spectrum for each frequency, an amplitude ratio between the frequency spectrum and the another frequency spectrum for each frequency, a phase difference between the frequency spectrum and the another frequency spectrum for each frequency, the another frequency spectrum being obtained by time-frequency transforming the voice signal obtained at a second spatial location different from a first spatial location at which the voice signal corresponding to the frequency spectrum has been obtained; and when the component of each frequency is determined to be not a target sound, setting, as the suppression coefficient, a coefficient based on a value obtained by multiplying a stationary noise coefficient in accordance with the amplitude value and the target value, by the noise-originating coefficient together.

9. The voice processing device according to claim 1, wherein the at least one processor further executes:

determining whether or not the frequency spectrum is a target sound when the frequency spectrum or any component of each frequency of the frequency spectrum is determined to be non-stationary on the basis of the amplitude value; and when the frequency spectrum is determined to be non-stationary, determining that the frequency spectrum that corresponds to the predetermined period of time is a target sound when a correlation value between the frequency spectrum corresponding to the predetermined period of time and a frequency spectrum corresponding to a predetermined period of time which is one before the predetermined period of time is higher than a certain value; and when the frequency spectrum is determined to be not a target sound, setting, as the suppression coefficient, a value obtained by multiplying a stationary noise coefficient in accordance with the amplitude value and the target value, and the noise-originating coefficient together.

10. The voice processing device according to claim 1, wherein, when a is a positive coefficient used for calculating the noise-originating coefficient based on a maximum value of the target value in the predetermined period of time, the target value is x, and the noise-originating coefficient is y, a relationship between a, x, and y is expressed as $$y=1-ax.$$

11. The voice processing device according claim 1, wherein, when b is a positive coefficient used for calculating the noise-originating coefficient based on a maximum value of the target value in the predetermined period of time, the target value is x, and the noise-originating coefficient is y, a relationship between a, x, and y is expressed as $$y=1-ax^2.$$

12. A noise suppression method which is performed by a computer, comprising:

obtaining a frequency spectrum by time-frequency transforming a voice signal for a predetermined period of time;

determining an amplitude value of the obtained frequency spectrum;

calculating a target value based on the amplitude value;

after the target value is calculated, calculating a noise-originating coefficient that gradually and consistently decreases as the target value of stationary noise for each frequency increases;

generating, when the frequency spectrum is determined as being stationary on the basis of the amplitude value, a suppression signal by multiplying a suppression coefficient based on the noise-originating coefficient by the amplitude value, the suppression signal being frequency-time transformed to be output; and outputting the generated suppression signal to a speaker.

13. The noise suppression method according to claim 12, further comprising:

determining, when a component of each frequency of the frequency spectrum is determined to be non-stationary, whether or not the component of each frequency is a target sound, and wherein, when a component of each frequency is determined to be not a target sound, the suppression signal generation section sets, as the suppression coefficient, a coefficient based on a value obtained by multiplying a stationary noise coefficient in accordance with the amplitude value and the target value, and the noise-originating coefficient together.

14. The noise suppression method according to claim 13, further comprising:

calculating a target sound ratio that indicates a ratio of the target sound in the frequency spectrum; and setting, when it is determined that the component of each frequency is not a target sound in the frequency spectrum, as the suppression coefficient, a value calculated in accordance with the target sound ratio as the suppression coefficient.

15. A non-transitory computer readable recording medium storing voice processing program for causing a voice processing device to execute a procedure, the procedure comprising:

obtaining a frequency spectrum by time-frequency transforming a voice signal for a predetermined period of time;

determining an amplitude value of the obtained frequency spectrum;

calculating a target value based on the amplitude value;

after the target value is calculated, calculating a noise-originating coefficient that gradually and consistently decreases as the target value of stationary noise for each frequency increases;

generating, when the frequency spectrum is determined as being stationary on the basis of the amplitude value, a suppression signal by multiplying a suppression coefficient based on the noise-originating coefficient by the amplitude value, the suppression signal being frequency-time transformed to be output; and outputting the generated suppression signal.

* * * * *